US011710376B2

(12) United States Patent
Berman

(10) Patent No.: US 11,710,376 B2
(45) Date of Patent: Jul. 25, 2023

(54) GAMING DEVICES AND METHODS FOR ENRICHING SUBSEQUENT GAMING ACTIVITY BASED ON CURRENT GAMING ACTIVITY

(71) Applicant: KING SHOW GAMES, INC., Minnetonka, MN (US)

(72) Inventor: Bradley Berman, Minnetonka, MN (US)

( * ) Notice: Subject to any disclaimer, the term of this patent is extended or adjusted under 35 U.S.C. 154(b) by 0 days.

(21) Appl. No.: 16/673,494

(22) Filed: Nov. 4, 2019

(65) Prior Publication Data

US 2020/0143639 A1 May 7, 2020

Related U.S. Application Data

(60) Provisional application No. 62/755,699, filed on Nov. 5, 2018.

(51) Int. Cl.
*G07F 17/32* (2006.01)

(52) U.S. Cl.
CPC ..... *G07F 17/3267* (2013.01); *G07F 17/3211* (2013.01); *G07F 17/3227* (2013.01); *G07F 17/3244* (2013.01); *G07F 17/3262* (2013.01); *G07F 17/3276* (2013.01); *G07F 17/3293* (2013.01); *G07F 17/3239* (2013.01)

(58) Field of Classification Search
CPC ..... G07F 17/3267; G07F 17/3244; G07F 17/3293; G07F 17/3262; G07F 17/3211; G07F 17/3276; G07F 17/3227; G07F 17/3239
USPC ..... 463/13
See application file for complete search history.

(56) References Cited

U.S. PATENT DOCUMENTS

| | | | | |
|---|---|---|---|---|
| 5,531,448 | A | 7/1996 | Moody | |
| 5,732,950 | A | 3/1998 | Moody | |
| 5,823,873 | A | 10/1998 | Moody | |
| 6,007,066 | A | 12/1999 | Moody | |
| 6,098,985 | A | 8/2000 | Moody | |
| 6,203,429 | B1 * | 3/2001 | Demar | G07F 17/32 463/20 |
| 6,312,334 | B1 * | 11/2001 | Yoseloff | G07F 17/3244 463/20 |
| 6,419,578 | B1 | 7/2002 | Moody et al. | |
| 6,672,959 | B2 | 1/2004 | Moody et al. | |
| 7,156,397 | B2 | 1/2007 | Moody et al. | |
| 8,690,659 | B2 | 4/2014 | Moody | |
| 9,067,144 | B1 | 6/2015 | Nottke | |
| 9,138,634 | B2 | 9/2015 | Moody | |
| 9,569,934 | B2 | 2/2017 | Berman | |
| 9,576,431 | B2 | 2/2017 | Berman et al. | |

(Continued)

OTHER PUBLICATIONS

The Wizard of Odds, "Wheel Poker Deluxe", Mar. 2, 2019.
www.888casino.com, "Quick Quads Poker", Mar. 7, 2018.

*Primary Examiner* — Robert P Bullington, Esq.
*Assistant Examiner* — Stephen Alvesteffer

(57) ABSTRACT

Systems, apparatuses and methods for identifying positions of card hands that will be accorded some heightened value or enrichment on a future hand(s) of the game. In one embodiment, a player of a poker game may be notified in connection with a current hand that some preset progress or other partial progress is made towards a potentially favorable result, where that progress is made known to the player so that the player knows it is coming on a subsequent poker game.

16 Claims, 19 Drawing Sheets

(56) References Cited

U.S. PATENT DOCUMENTS

| | | | | |
|---|---|---|---|---|
| 9,576,437 | B2 | 2/2017 | Berman | |
| 9,916,731 | B2 | 3/2018 | Mien et al. | |
| 10,008,075 | B2 | 6/2018 | Berman | |
| 10,176,675 | B2 | 1/2019 | Moody et al. | |
| 10,553,080 | B2 | 2/2020 | Berman | |
| 2003/0032469 | A1* | 2/2003 | Moody | A63F 1/00 463/13 |
| 2003/0040352 | A1 | 2/2003 | Marks et al. | |
| 2003/0157977 | A1* | 8/2003 | Thomas | G07F 17/3267 463/16 |
| 2004/0116170 | A1 | 6/2004 | Walker et al. | |
| 2007/0238503 | A1* | 10/2007 | Kowell | G07F 17/3255 463/12 |
| 2008/0102918 | A1* | 5/2008 | Campagno | G07F 17/3258 463/16 |
| 2009/0061975 | A1* | 3/2009 | Ditchev | G07F 17/3293 463/13 |
| 2011/0117980 | A1* | 5/2011 | Parham | G07F 17/32 463/13 |
| 2014/0045579 | A1 | 2/2014 | Filipour et al. | |
| 2014/0206424 | A1* | 7/2014 | Taylor | G07F 17/3293 463/13 |
| 2014/0302903 | A1* | 10/2014 | Berman | G07F 17/3246 463/13 |
| 2018/0130305 | A1 | 5/2018 | Berman et al. | |

* cited by examiner

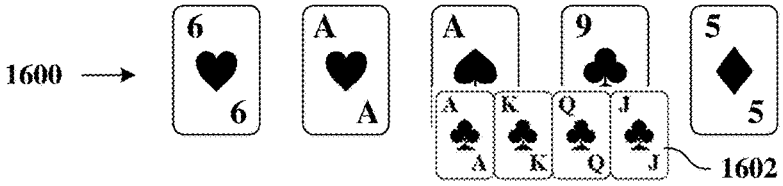
FIG. 16A
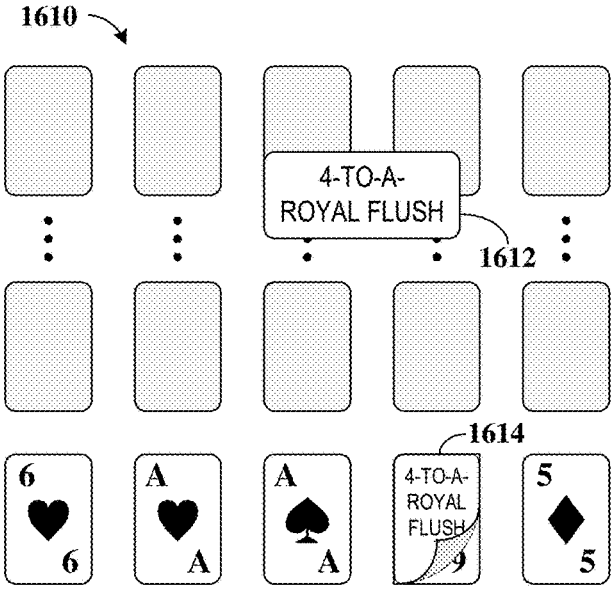
FIG. 16B
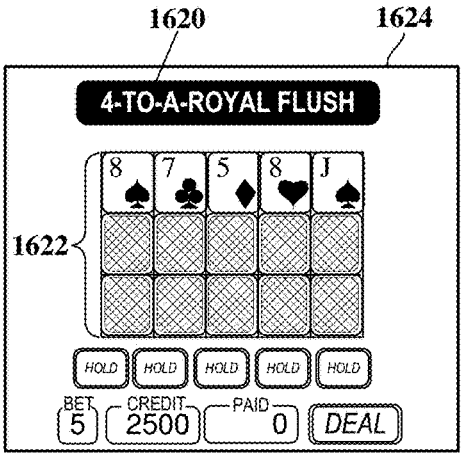
FIG. 16C
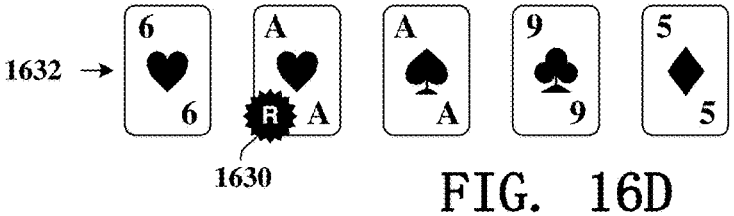
| 1636 | 1638 |
|---|---|
| RED | 4-TO-A-RF |
| BLUE | 4-TO-A-FLUSH |
| GREEN | 3-TO-QUADS |
1634
FIG. 16D
| 1642 | 1644 |
|---|---|
| 10 CONSECUTIVE NO WINS | 4-TO-A-RF |
| 2 RED JACKS DEALT | 4-TO-A-FLUSH |
| A,3,5,7,9 | 3-TO-QUADS |
1640
FIG. 16E

GAMING DEVICES AND METHODS FOR ENRICHING SUBSEQUENT GAMING ACTIVITY BASED ON CURRENT GAMING ACTIVITY

FIELD

This disclosure relates generally to games, and more particularly to systems, apparatuses and methods for identifying positions of card hands that will be accorded some heightened value or enrichment on a future hand(s) of the game.

BACKGROUND

Casino games such as poker, slots, and craps have long been enjoyed as a means of entertainment. Some of these games originated using traditional elements such as playing cards or dice. More recently, gaming devices have been developed to simulate and/or further enhance these games while remaining entertaining. The popularity of casino gambling with wagering continues to increase, as does recreational gambling such as non-wagering computer game gambling. Part of this popularity is due to the increased development of new types of games that are implemented, at least in part, on gaming devices.

One reason that casino games are widely developed for gaming devices is that a wide variety of games can be implemented on gaming devices, thereby providing an array of choices for players looking to gamble. For example, the graphics and sounds included in such games can be modified to reflect popular subjects, such as movies and television shows. Game play rules and types of games can also vary greatly providing many different styles of gambling. Additionally, gaming devices require minimal supervision to operate on a casino floor, or in other gambling environments. That is, as compared to traditional casino games that require a dealer, banker, stickman, pit managers, etc., gaming devices need much less employee attention to operate.

With the ability to provide new content, players have come to expect the availability of an ever wider selection of new games when visiting casinos and other gaming venues. Playing new games adds to the excitement of "gaming." As is well known in the art and as used herein, the term "gaming" and "gaming devices" generally involves some form of wagering, and that players make wagers of value, whether actual currency or something else of value, e.g., token or credit. Wagering-type games usually provide rewards based on random chance as opposed to skill, although some skill may be an element in some types of games. Since random chance is a significant component of these games, they are sometimes referred to as "games of chance."

The present disclosure describes systems, apparatuses and methods that facilitate new and interesting gaming experiences, and provide advantages over the prior art.

SUMMARY

The present disclosure is directed to systems, apparatuses, computer-readable media, and/or methods that are configured to accord a heightened value and/or other enrichment on a future hand(s) of the game. In some embodiments, one or more cards to be made available on a subsequent hand(s) are identified in the earlier hand(s), such as identifying a subset of a desirable resulting hand(s) that is made available on a subsequent hand to in essence provide the player with a "head start" towards that desirable resulting hand(s).

In accordance with one embodiment, a video poker apparatus is provided for facilitating player participation in electronic poker games. The video poker apparatus includes a display, a user interface to receive at least player input to facilitate player participation in the poker game, a wager input device structured to identify and validate player assets and permit the player to participate in the electronic poker games in which the player assets are provided. The video poker apparatus also includes a processor coupled to the display, user interface, and the wager input device. In one embodiment, the processor is configured to determine whether the player has, in connection with playing a current poker game, randomly received an award for use with a subsequent poker game. In response to determining that the player has randomly received the award, the processor specifies a plurality of cards to be used with the subsequent poker game, and presents the specified cards to the player via the coupled display. When the processor determines that the player is participating in the subsequent poker game, the processor applies the specified plurality of cards as a subset of a hand associated with the subsequent poker game, and randomly selects cards for remaining positions of the hand. The processor is configured to determine a poker result for the hand, and present that poker result to the player via the display.

In a more particular embodiment of such a video poker apparatus, the processor is further configured to present, via the display, a visual indication indicating that it has been determined that the player has randomly received the award for use with the subsequent poker game. In one embodiment, the processor is configured to specify the cards to be used with the subsequent poker game by presenting, via the display, visual representations of specific cards of a virtual deck that will be used with the subsequent poker game. In another embodiment, the processor is configured to specify the cards to be used with the subsequent poker game by presenting, via the display, a textual representation of a card group forming a subset of a predetermined winning poker result having a payout associated therewith. In still another embodiment, the processor is configured to specify the cards to be used with the subsequent poker game by presenting, via the display, indicia having corresponding specific cards or a card group in a correlation table.

In another particular embodiment of such a video poker apparatus, the processor is further configured to determine whether the player has randomly received an award for use with a subsequent poker game by determining whether randomly-presented cards used in the current poker game matches predetermined card characteristics set to trigger the random receipt of the award for use with the subsequent poker game. In a more particular embodiment, the processor is further configured to specify the cards to be used with the subsequent poker game to be the same randomly-presented cards used in the current poker game that matched the predetermined card characteristics.

In another particular embodiment of such a video poker apparatus, the processor is further configured to determine whether the player has randomly received an award for use with a subsequent poker game by determining whether one or more randomly-presented cards presented at particular card positions of a hand in the current poker game matches predetermined card characteristics.

In another particular embodiment of such a video poker apparatus, the processor is configured to select the plurality of cards to be used with the subsequent poker game from a plurality of available groups of cards.

In another particular embodiment of such a video poker apparatus, the processor is configured to specify the plurality of cards to be used with the subsequent poker game as specific cards from one or more electronic decks of cards.

In another particular embodiment of such a video poker apparatus, the processor is configured to specify the plurality of cards to be used with the subsequent poker game as card groups sharing at least one common characteristic from one or more electronic decks of cards.

In another particular embodiment of such a video poker apparatus, the processor is further configured to determine whether the poker result corresponds to a predetermined winning poker result, and if so, to provide a payout based on that poker result.

In another particular embodiment of such a video poker apparatus, the poker result is based on the specified plurality of cards and the randomly select cards.

In another particular embodiment of such a video poker apparatus, the processor is further configured to facilitate player participation in the hand associated with the subsequent poker game prior to determining the poker result for the hand. In a more particular embodiment, the processor is configured to randomly select one or more additional cards, and to facilitate player selection of a five-card hand by retaining five of the cards from the collection of the specified plurality of cards, the randomly selected cards, and the randomly selected one or more additional cards. In another embodiment, the processor is further configured to facilitate player retention of any one or more of the cards of a group comprising the specified plurality of cards and the randomly selected cards, to facilitate player discardment of any of the cards of the group that were not retained, to provide replacement cards in place of the discarded cards, and to determine the poker result based on the retained cards and the replacement cards.

In accordance with another embodiment, a gaming device is provided for enabling player participation in successive poker games. The gaming device includes a display, a user interface configured to receive at least player input to facilitate player participation in the poker game, a wager input device structured to identify and validate player assets and permit the player to participate in the successive poker games in which the player assets are provided, and a processor. The processor in this embodiment is configured to notify the player, at least by way of the display, that an award of a subsequent poker hand benefit has been awarded during play of a current poker game in which the player is permitted to participate. The processor is configured to present to the player, at least by way of the display, hand enrichment cards reflecting the subsequent poker hand benefit. The processor is further configured to present, at least by way of the display, a current hand of cards in association with the currently-played poker game, and enable the current hand of cards to be played to a current poker hand result. The processor is further configured to present, at least by way of the display, a subsequent poker hand of cards that includes the hand enrichment cards and one or more additional dealt cards to complete the subsequent poker hand of cards. The processor is further configured to enable the subsequent poker hand to be played to completion, and to determine a subsequent poker hand result for the completed subsequent poker hand that includes the hand enrichment cards and the additional dealt cards. The processor is further configured to present, at least by way of the display, the subsequent poker hand result and any payout associated therewith.

In a more particular embodiment of such a gaming device, the processor is further configured to facilitate, via the user interface, player holding and discarding of any of the cards in the subsequent poker hand after the subsequent poker hand has received the hand enrichment cards and has been completed with the one or more additional dealt cards. The processor in such embodiment may be further configured to provide replacement cards in place of any of the cards that were discarded, and determine the subsequent poker hand result based on the held cards and the replacement cards, whether or not any of the hand enrichment cards were held.

In another embodiment of such a gaming device, the processor is further configured to facilitate, via the user interface, player holding and discarding of any of the one or more additional dealt cards, to provide replacement cards in place of any of the additional dealt cards that were discarded, and to determine the subsequent poker hand result based on the hand enrichment cards and on any held and replacement cards.

In another embodiment of such a gaming device, the processor is further configured to select the hand enrichment cards from a plurality of available sets of the hand enrichment cards.

This summary serves as an abbreviated, selective introduction of a representative subset of various concepts and embodiments that are further described or taught to those skilled in the art in the Specification herein. This summary is not intended to refer to all embodiments, scopes, or breadths of claims otherwise supported by the Specification, nor to identify essential features of the claimed subject matter, nor to limit the scope of the claimed subject matter.

BRIEF DESCRIPTION OF THE DRAWINGS

FIGS. 16A-16G depict representative examples of providing indications of the award of an enrichment or benefit to a subsequent poker hand or other gaming event.

DETAILED DESCRIPTION

Figure 1:
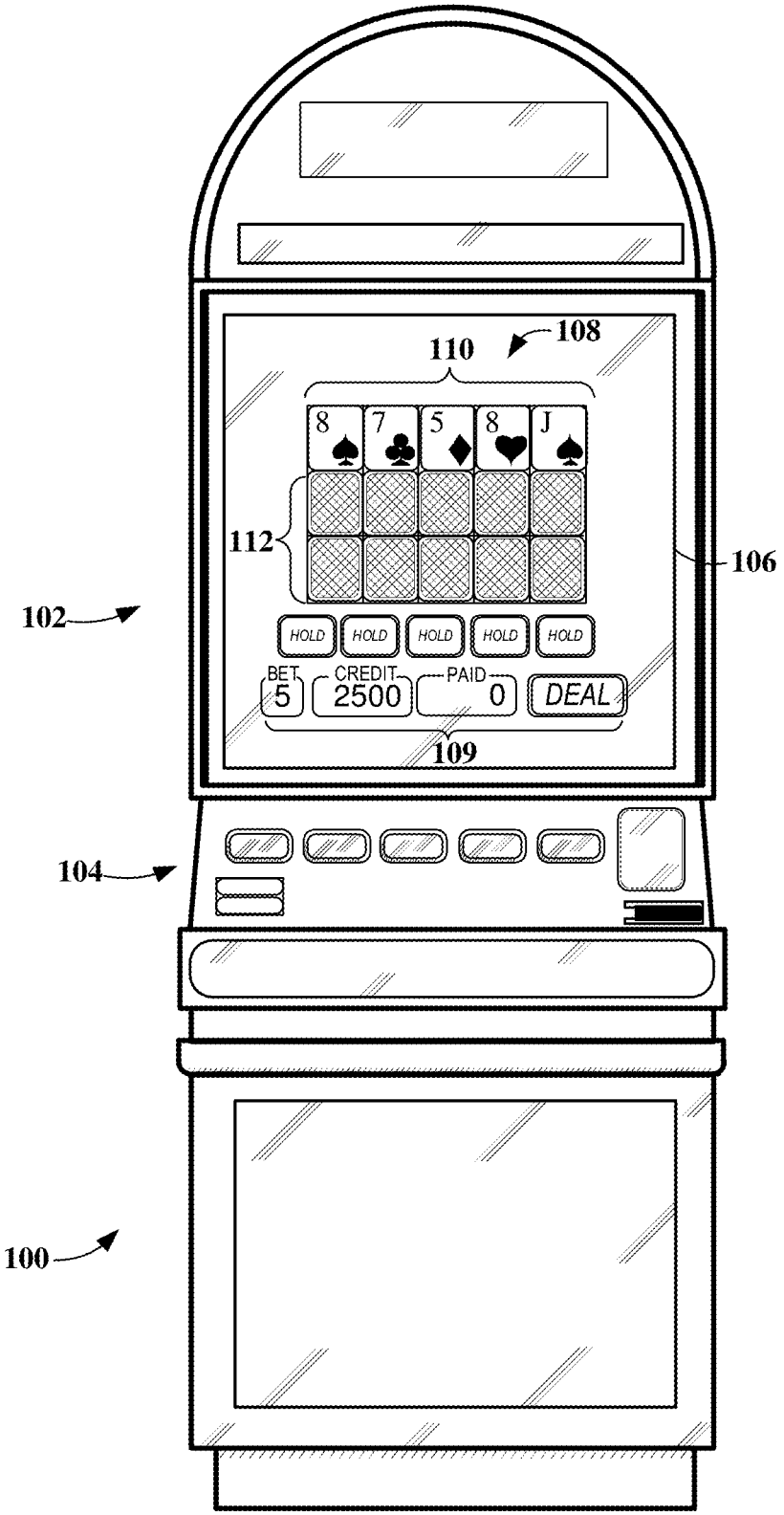
FIG. 1 is a diagram of a representative gaming machine capable of facilitating player use and interaction with games and features in accordance with the invention and representative embodiments described herein.

In the following description of various exemplary embodiments, reference is made to the accompanying drawings which form a part hereof, and in which is shown by way of illustration representative embodiments in which the features described herein may be practiced. It is to be understood that other embodiments may be utilized, as structural and operational changes may be made without departing from the scope of the disclosure.

In the description that follows, the terms "reels," "cards," "decks," and similar mechanically descriptive language may be used to describe various apparatus presentation features, as well as various actions occurring to those objects (e.g., "spin," "draw," "hold," "bet"). Although the present disclosure may be applicable to manual, mechanical, and/or computerized embodiments, as well as any combination therebetween, the use of mechanically descriptive terms is not meant to be only applicable to mechanical embodiments. Those skilled in the art will understand that, for purposes of providing gaming experiences to players, mechanical elements such as cards, reels, and the like may be simulated on a display in order to provide a familiar and satisfying experience that emulates the behavior of mechanical objects, as well as emulating actions that occur in the non-computerized games (e.g., spinning, holding, drawing, betting). Further, the computerized version may provide the look of mechanical equivalents but may be generally randomized in a different way. Thus, the terms "cards," "decks," "reels," "hands," etc., are intended to describe both physical objects and emulation or simulations of those objects and their behaviors using electronic apparatuses.

In various embodiments, the gaming displays are described in conjunction with the use of data in the form of "symbols." In the context of this disclosure, a "symbol" may generally refer at least to a collection of one or more arbitrary indicia or signs that have some conventional or defined significance. In particular, the symbol may represent values that can at least be used to determine whether to award a payout. A symbol may include numbers, letters, shapes, pictures, textures, colors, sounds, etc., and any combination therebetween. A play state, such as a win, can be determined by comparing the symbol with one or more other symbols. Such comparisons can be performed, for example, via software by mapping numbers (or other data structures such as character strings) to the symbols and performing the comparisons on the numbers/data structures. Other conventions associated with known games (e.g., the numerical value/ordering of face cards and aces in card games) may also be programmatically analyzed to determine winning combinations.

Generally, systems, apparatuses and methods are disclosed for identifying card positions, in hands of poker or other card games, that will be accorded some heightened value or enrichment on a future hand(s) of the game. The systems, apparatuses and methods described herein may be implemented as a single game, or part of a multi-part game. For example, the game features described herein may be implemented in primary gaming activities, bonus games, side bet games or other secondary games associated with a primary gaming activity. The game features may be implemented in stand-alone games, multi-player games, etc. Further, the disclosure may be applied to games of chance, and descriptions provided in the context of any representative game (e.g. poker, such as video poker) is provided for purposes of facilitating an understanding of the features described herein. However, the principles described herein are equally applicable to any game of chance where an outcome(s) is determined for use in the player's gaming activity.

Embodiments of the present concept include providing gaming devices (also referred to as gaming apparatuses or gaming machines), gaming systems, and methods of operating these devices or systems to provide game play that involves randomly or otherwise identifying game indicia positions in current gaming activities that will have their associated game indicia enriched or otherwise benefitted in one or more future gaming activities.

In one embodiment, the gaming activity comprises a card game, which may involve a single hand of cards or multiple hands of cards. The cards serve as the indicia that enables games to be conducted, through interaction of the card indicia. Cards in a current gaming activity may be marked or otherwise designated at card positions, or alternatively a count of cards, that will be enhanced, enriched, or otherwise exhibit a higher payout potential and/or likelihood of achieving a winning result.

As noted above, some embodiments involve providing a number/count of cards that will be enriched in a subsequent hand(s). In a more particular embodiment, the number of cards to be enriched in a subsequent hand(s) may be particular cards, and in still other embodiments may be made known to the player. For example, in some embodiments, one or more cards to be made available on a subsequent hand(s) are specifically identified in the earlier hand(s), such as identifying a subset of a desirable resulting hand(s) that is made available on a subsequent hand(s) to in essence provide the player with a "head start" towards that desirable resulting hand(s). In this manner, and as an example, the player may be notified in a current hand that some preset progress or other partial progress is made towards a potential valuable winning result or any winning result, or such progress is made towards any of a plurality of potential valuable winning results or other winning results.

These principles may be applied in a poker context, regardless of the type of poker game. The poker game may involve stud poker variations, draw poker variations, community card poker variations, any combination thereof, or any other wagering game utilizing cards. In one embodiment, one or more cards of a hand(s) in a single or multiple hand game may be randomly or systematically marked, and cards that are dealt to those marked positions in a subsequent hand(s) are benefitted or upgraded in some way, such as changing to a higher value, changing to a card more likely to result in a winning combination (e.g., wild card) and/or higher payout (e.g., multiplier or other payout modifier), etc.

In one embodiment, the precise positions of such cards is not provided, but rather a count of the number of cards (if any) that will be available for subsequent hand upgrades is provided in connection with a current poker game, and that number of cards (if any) will be upgraded or otherwise changed in a future poker game. For example, a random award of two poker card replacements may be awarded on a current poker hand, and on the next (or later) hand, two poker cards will be allowed to change to higher win and/or payout likelihood cards, and/or other enriched or higher value cards. The cards to be changed in such an embodiment may be fixed (e.g., change the number of cards from left to right in the future hand(s)), randomly selected, selected in response to other play conditions or occurrences (e.g., condition-based or rule-based card position selections), or the like.

In another embodiment, particular cards are identified in a current hand for use as enriched cards in one or more subsequent hands. While one embodiment involves informing the player in the current hand of which particular cards will be made available in the subsequent hand(s), another embodiment does not immediately inform the player of which cards will be made available in the subsequent hand but rather just that some subset of a winning hand will be provided. Thus, in some embodiments, one or more cards to be made available on a subsequent hand(s) are specifically identified in the earlier hand(s), such as identifying a subset of a desirable resulting hand(s) that is made available on a subsequent hand(s) to provide the player with immediate progress towards that desirable resulting hand(s). By way of example only, an indication may be provided that three cards towards a Royal Flush will be provided on the next hand (or up to one or more additional hands if multiple hands are played), such as a like-suited Ace, King, and Queen, or a like-suited Jack, Queen, King, etc. In embodiments where the particular resulting hand subset is made known to the player during participation in a current hand, the indication may be provided during play of the current hand in any desired fashion, whether by showing the particular cards (Ace-Hearts, King-Hearts, Queen-Hearts, etc.), providing text and/or graphics information (e.g. "3 cards to a Royal Flush;" "3 cards to four-of-a-kind," etc.), providing indicia such as sub-symbols with a legend or other manner of corresponding provided indicia with the cards to be available on the subsequent hand(s), or any other manner of presenting the information for the player's awareness. Such cards may be made available on the subsequent hand(s) in a stud poker fashion (e.g. no card discarding/replacement for the hand receiving the beneficial cards), or where they can be replicated into other hands in a multi-play poker fashion, or where they cannot be replicated into other hands, or in a draw poker fashion (e.g. allowing card discarding/replacement for the hand receiving the beneficial cards), etc.

Numerous variations are possible in view of these and other embodiments of the inventive concept. Representative embodiments and variations are described herein, with some embodiments described with reference to the drawings. However, many other embodiments and variations exist that are covered by the principles and scope of this concept. For example, although some of the embodiments discussed below involve electronic/video poker examples of this concept, other embodiments include application of these inventive techniques in of slot games, other card games, roulette, bingo, keno, or other games of chance. Some of these other types of embodiments will be discussed below as variations to the examples illustrated. However, many other types of games can implement similar techniques and fall within the scope of this disclosed concept.

Referring to the example gaming apparatus 100 shown in FIG. 1, the representative gaming apparatus includes at least a display area(s) 102 (also referred to as a gaming display), and a player interface area(s) 104, although some or all of the interactive mechanisms included in the user interface area 104 may be provided via other or additional means, such as graphical icons used with a touch screen in the display area 102 in some embodiments. The display area 102 may include one or more game displays 106 (also referred to as "displays" or "gaming displays") that may be included in physically separate displays or as portions of a common large display. Here, the representative game display 106 includes at least a primary game play portion 108 that displays game elements and symbols 110, and an operations portion 109 that can include meters, various game buttons and other input mechanisms, and/or other game information for a player of the gaming device 100.

The user interface 104 allows the user to control, engage in play of, and otherwise interact with the gaming machine 100. The particular user interface mechanisms included with user interface 104 may be dependent on the type of gaming device. For example, the user interface 104 may include one or more buttons, switches, joysticks, levers, pull-down handles, trackballs, voice-activated input, touchscreen input, tactile input, and/or any other user input system or mechanism that allows the user to play and interact with the particular gaming activity.

The user interface 104 may allow the user or player to enter coins, bills, or otherwise obtain credits through vouchers, tokens, credit cards, tickets, electronic money, etc. Various mechanisms for entering such vouchers, tokens, credit cards, coins, tickets, etc. are described below with reference to FIG. 2. For example, currency input mechanisms, card readers, credit card readers, smart card readers, punch card readers, radio frequency identifier (RFID) readers, and other mechanisms may be used to enter wagers. The user interface 104 may also include a mechanism to read and/or validate player information, such as player loyalty information to identify a user or player of the gaming device. This mechanism may be, for example, a card reader, biometric scanner, keypad, or other input device. It is through a user interface such as the user interface 104 that the player can initiate and engage in gaming activities. While the illustrated embodiment depicts various buttons for the user interface 104, it should be recognized that a wide variety of user interface options are available for use in connection with the present invention, including pressing buttons, touching a segment of a touch-screen, entering text, entering voice commands, or other known data entry methodology.

The game display 106 in the display area 102 may include one or more of an electronic display, a video display, a mechanical display, and fixed display information, such as pay table information associated with a glass/plastic panel(s) on the gaming machine 100 and/or graphical images. The symbols or other indicia associated with the play of the game may be presented on an electronic display device or on mechanical devices associated with a mechanical display. Generally, in some embodiments, the display 106 devotes the largest portion of viewable area to the primary gaming portion 108. The primary gaming portion 108 may provide visual feedback to the user for any selected game. The primary gaming portion 108 may render graphical objects such as cards, slot reels, dice, animated characters, and any other gaming visual known in the art. The primary gaming portion 108 may also inform players of the outcome of any particular event, including whether the event resulted in a win or loss.

In some embodiments described herein, the primary gaming portion 108 may display a grid(s) or equivalent arrangement(s) of playing cards 110 forming one or more hands or other sets of cards in a card game, such as a poker game. In the illustrated example, a set of five playing cards 110 forms a video poker hand, which represents a portion of a game play event. For example, if the game play event is a video draw poker game, the gaming device 100 may deal five cards, allow the user to select cards to hold, deal replacements for the cards not held, and determine a payout based on the final cards in the hand. The illustration and description of five-card draw poker is for purposes of example and not of limitation, as the disclosure is applicable to numerous other card games, such as stud poker, hold 'em poker or other community card poker games, or any other poker game involving sequentially-played poker games or hands, as well as other types of gaming activities and apparatuses, such as slot machines, dice, coins, etc. For example, some embodiments may relate to slot games, where the primary gaming portion 108 presents a grid (or equivalent arrangement) of symbols or other game elements in respective symbol locations (not shown), where the symbols or combinations of symbols determine gaming outcomes.

In some embodiments, the primary gaming portion 108 may also display one or more additional hands 112 of playing cards, such as in a multi-play poker embodiment. For example, one multi-play poker embodiment involves draw poker, where at least one hand 110 is dealt, and cards held by the player in hand 110 are replicated into one or more other hands 112, whereby all hands 110, 112 may then be completed with replacement cards while having one or more commonly held cards. Multi-play embodiments may also be played without holding any cards, and/or without replication of held cards into other hands. In some embodiments, other hands 112 may represent discrete, individually-played additional hands of cards that are unrelated to the play of other hands 110.

The primary gaming portion 108 may include other features known in the art that facilitate gaming, such as status and control portion 109. As is generally known in the art, this portion 109 provides information about current bets, current wins, remaining credits, etc. associated with gaming activities of the grid of game elements 110. The control portion 109 may also provide touchscreen controls for facilitating game play. The grid of game elements 110 may also include touchscreen features, such as facilitating selection of individual cards to hold and/or selection of individual cards to discard and replace (e.g., in a draw poker embodiment), which subset of cards of a larger set of cards to hold/use for a final hand(s) (e.g., in some stud poker embodiments), wagering inputs, etc. The game display 106 of the display area 102 may include other features that are not shown, such as pay tables, navigation controls, etc.

Figure 2:
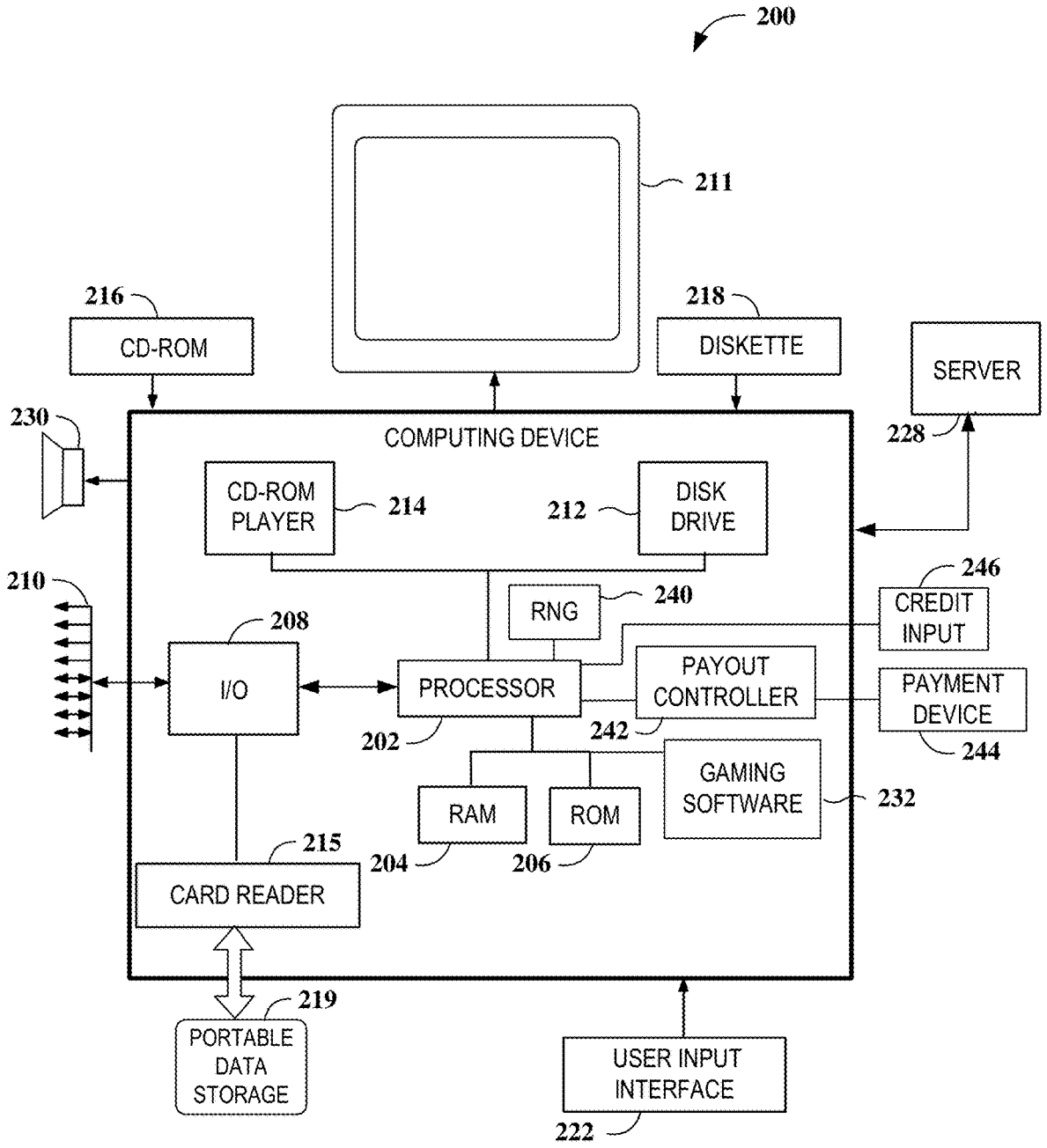
FIG. 2 is a block diagram illustrating a representative computing arrangement capable of implementing games and features in accordance with the invention and representative embodiments described herein.

Although FIG. 1 illustrates a particular implementation of some of the embodiments in a casino or electronic gaming machine ("EGM"), one or more devices may be programmed to play various embodiments of the disclosure. The concepts and embodiments described herein may be implemented, as shown in FIG. 1, as an electronic/video gaming machine or other special purpose gaming kiosk, or may be implemented via computing systems operating under the direction of local gaming software, and/or remotely-provided software such as provided by an application service provider (ASP). Such gaming machines may also utilize computing systems to control and manage the gaming activity, although these computing systems typically include specialized components and/or functionality to operate the particular elements of electronic gaming machines. Additionally, computing systems operating over networks, such as the Internet, may also include specialized components and/or functionality to operate elements particular to these systems, such as random number generators. An example of a representative computing system capable of carrying out operations in accordance with the principles described herein is illustrated in FIG. 2.

Hardware, firmware, software or any combination thereof may be used to perform the various gaming functions, display presentations and operations described herein. The functional modules used in connection with the disclosure may reside in a gaming machine as described, or may alternatively reside on a stand-alone or networked computer. The representative computing structure 200 of FIG. 2 is an example of a computing structure that can be used in connection with such electronic gaming machines, computers, or other computer-implemented devices to carry out operations of the present invention. Although numerous components or elements are shown as part of this computing structure 200 in FIG. 2, additional or fewer components may be utilized in particular implementations of embodiments of the invention.

The example computing arrangement 200 suitable for performing the gaming functions described herein includes a processor(s), such as depicted by the representative central processing unit (CPU) 202, coupled to memory, such as random access memory (RAM) 204, and some variation of read-only memory (ROM) 206 or other persistent storage. The ROM 206 may also represent other types of storage media to store programs, such as programmable ROM (PROM), erasable PROM (EPROM or any technology capable of storing data). The processor 202 may communicate with other internal and external components through input/output (I/O) circuitry 208 and bussing 210, to communicate control signals, communication signals, and the like.

The computing arrangement 200 may also include one or more data storage devices, including hard and floppy disk drives 212, CD-ROM drives 214, card reader 215, and other hardware capable of reading and/or storing information such as DVD, etc. In one embodiment, software for carrying out the operations in accordance with the present invention may be stored and distributed on a CD-ROM 216, diskette 218, access card 219, or other form of computer readable media capable of portably storing information. These storage media may be inserted into, and read by, devices such as the CD-ROM drive 214, the disk drive 212, card reader 215, etc. The software may also be transmitted to the computing arrangement 200 via data signals, such as being downloaded electronically via a network, such as local area network (casino, property, or bank network) or a wide area network (e.g., the Internet). Further, as previously described, the software for carrying out the functions associated with the present invention may alternatively be stored in internal memory/storage of the computing device 200, such as in the ROM 206.

The computing arrangement 200 is coupled to one or more displays 211, which represent a manner in which the gaming activities may be presented. The display 211 represents the "presentation" of the game information in accordance with the disclosure, and may be a mechanical display, or an electronic/video display such as liquid crystal displays, plasma displays, cathode ray tubes (CRT), digital light processing (DLP) displays, liquid crystal on silicon (LCOS) displays, etc., or any type of known display or presentation screen.

Where the computing device 200 represents a stand-alone or networked computer, the display 211 may represent a standard computer terminal or display capable of displaying multiple windows, frames, etc. Where the computing device 200 represents a mobile electronic device, the display 211 may represent the video display of the mobile electronic device. Where the computing device 200 is embedded within an electronic gaming machine, the display 211 corresponds to the display screen of the gaming machine/kiosk.

A user input interface 222 such as a mouse, keyboard/keypad, microphone, touch pad, trackball, joystick, touch screen, voice-recognition system, card reader, biometric scanner, RFID detector, etc. may be provided. The user input interface 222 may be used to input commands in the computing arrangement 200, such as placing wagers or initiating gaming events on the computing arrangement 200, inputting currency or other payment information to establish a credit amount or wager amount, inputting data to identify a player for a player loyalty system, etc. The display 211 may also act as a user input device, e.g., where the display 211 is a touchscreen device. In embodiments, where the computing device 200 is implemented in a personal computer, tablet, smart phone, or other consumer electronic device, the user interface and display may be the available input/output mechanisms related to those devices.

Chance-based gaming systems such as slot machines, in which the present invention is applicable, are governed by random numbers and processors, as facilitated by a random number generator (RNG) or other random generator. The fixed and dynamic symbols generated as part of a gaming activity may be produced using one or more RNGs. RNGs may be implemented using hardware, software operable in connection with the processor 202, or some combination of hardware and software. The principles described herein are operable using any known RNG, and may be integrally programmed as part of the processor 202 operation, or alternatively may be a separate RNG controller 240 that may be associated with the computing arrangement 200 or otherwise accessible such as via a network. The RNGs are often protected by one or more security measures to prevent tampering, such as by using secured circuitry, locks on the physical game cabinet, and/or remote circuitry that transmits data to the gaming device.

The computing arrangement 200 may be connected to other computing devices or gaming machines, such as via a network. The computing arrangement 200 may be connected to a network server(s) 228 in an intranet or local network configuration. The computer may further be part of a larger network configuration as in a global area network (GAN) such as the Internet. In such a case, the computer may have access to one or more web servers via the Internet. In other arrangements, the computing arrangement 200 may be configured as an Internet server and software for carrying out the operations in accordance with the present invention may interact with the player via one or more networks. The computing arrangement 200 may also be operable over a social network or other network environment that may or may not regulate the wagering and/or gaming activity associated with gaming events played on the computing arrangement.

Other components directed to gaming machine implementations include manners of gaming participant payment, and gaming machine payout. For example, a gaming machine including the computing arrangement 200 may also include a payout controller 242 to receive a signal from the processor 202 or other processor(s) indicating a payout is to made to a player and controlling a payout device 244 to facilitate payment of the payout to the player. In some embodiments, the payout controller 242 may independently determine the amount of payout to be provided to the participant or player. In other embodiments, the payout controller 242 may be integrally implemented with the processor 202. The payout controller 242 may be a hopper controller, a print driver, credit-transmitting device, bill-dispensing controller, accounting software, or other controller device configured to verify and/or facilitate payment to a player.

A payout or payment device 244 may also be provided in gaming machine embodiments, where the payment device 244 serves as the mechanism providing the payout to the player or participant. In some embodiments, the payment device 244 may be a hopper, where the hopper serves as the mechanism holding the coins/tokens of the machine, and/or distributing the coins/tokens to the player in response to a signal from the payout controller 242. In other embodiments, the payout device 244 may be a printer mechanism structured to print credit-based tickets that may be redeemed by the player for cash, credit, or other casino value-based currency or asset. In yet other embodiments, the payout device 244 may send a signal via the network server 228 or other device to electronically provide a credit amount to an account associated with the player, such as a credit card account or player loyalty account. The computing arrangement 200 may also include accounting data stored in, for example, one of the memory devices 204, 206. This accounting data may be transmitted to a casino accounting network or other network to manage accounting statistics for the computing arrangement or to provide verification data for the currency or currency-based tickets distributed by the payout device, such as providing the data associated with the bar codes printed on the currency-based tickets so they are identifiable as valid tickets for a particular amount when the player redeems them or inserts them in another gaming device.

The wager input module or device 246 represents any mechanism for accepting coins, tokens, coupons, bills, electronic fund transfer (EFT), tickets, credit cards, smart cards, membership/loyalty cards, or any other player assets, for which a participant inputs a wager amount. The wager input device 246 may include magnetic strip readers, bar code scanners, light sensors, or other detection devices to identify and validate physical currency, currency-based tickets, cards with magnetized-strips, or other medium inputted into the wager input device. When a particular medium is received in the wager input device 246, a signal may be generated to establish or increase an available credit amount or balance stored in the internal memory/storage of the computing device 200, such as in the RAM 204. Thereafter, specific wagers placed on games may reduce the available credit amount, while awards won may increase the available credit amount. It will be appreciated that the primary gaming software 232 may be able to control payouts via the payment device 244 and payout controller 242 for independently determined payout events.

Among other functions, the computing arrangement 200 provides an interactive experience to players via an input interface 222 and output devices, such as the display 211, speaker 230, etc. These experiences are generally controlled by gaming software 232 that controls a primary gaming activity of the computing arrangement 200. The gaming software 232 may be temporarily loaded into RAM 204, and may be stored locally using any combination of ROM 206, drives 212, media player 214, or other computer-readable storage media known in the art. The primary gaming software 232 may also be accessed remotely, such as via the server 228 or the Internet.

The primary gaming software 232 in the computing arrangement 200 may be an application software module. According to embodiments of the present invention, this software 232 provides a slot game or similar game of chance as described herein. For example, the software 232 may present, by way of the display 211, representations of symbols to map or otherwise display as part of a slot based game having reels. However, in other embodiments, the principles of this concept may be applied to poker games or other types of games of chance. One or more aligned positions of these game elements may be evaluated to determine awards based on a pay table. The software 232 may include instructions to provide other functionality as known in the art or as described and shown herein.

The systems, apparatuses and methods operable via these and analogous computing and gaming devices can support gaming features as described herein. In one embodiment, cards or card positions are identified at a first time, and favorable or more favorable cards are forced, or at least offered, at those card positions at a second time. Some embodiments relate to identifying card positions, in hands of poker or other card games, that will be accorded some heightened value or enrichment on a future hand(s) of the game. Some representative gaming devices incorporating principles disclosed herein provide, among other things, game play that involves randomly or otherwise identifying game indicia positions in current gaming activities that will have their associated game indicia enriched or otherwise benefitted in one or more future gaming activities.

In one embodiment, the gaming activity comprises a poker game, and cards in a current poker hand(s) may be marked or otherwise designated at card positions, or alternatively a count of cards, that will be enhanced, enriched, or otherwise exhibit a higher payout potential and/or likelihood of achieving a winning result in a subsequent poker hand(s).

In one embodiment, one or more cards of a hand(s) in a single or multiple hand game may be randomly or systematically marked, and cards that are dealt to those marked positions in a subsequent hand(s) are benefitted or upgraded in some way, such as changing to a higher value, changing to a card more likely to result in a winning combination (e.g., wild card) and/or higher payout (e.g., multiplier or other payout modifier), etc.

In one embodiment, the number of cards positions (if any) that will be made available for subsequent card upgrades is provided in connection with a current poker game, and that number of cards (if any) will be upgraded or otherwise changed in a future poker game. In one embodiment, the card positions in the future poker game are selected randomly, in the quantity identified in the current poker game, to be upgraded. In another embodiment, the card positions in the future poker game are assigned according to rules, such as the quantity of cards to be upgraded starting from the leftmost position in the hand(s), or the rightmost position, etc.

Many embodiments may be described in terms of an electronic poker game, where presented cards potentially form a result(s) that conforms to a predetermined winning outcome to determine payout awards. However, the principles described herein are equally applicable to other games of chance, as described herein and as will be readily apparent to those skilled in the art from the teachings herein.

Figure 3A:
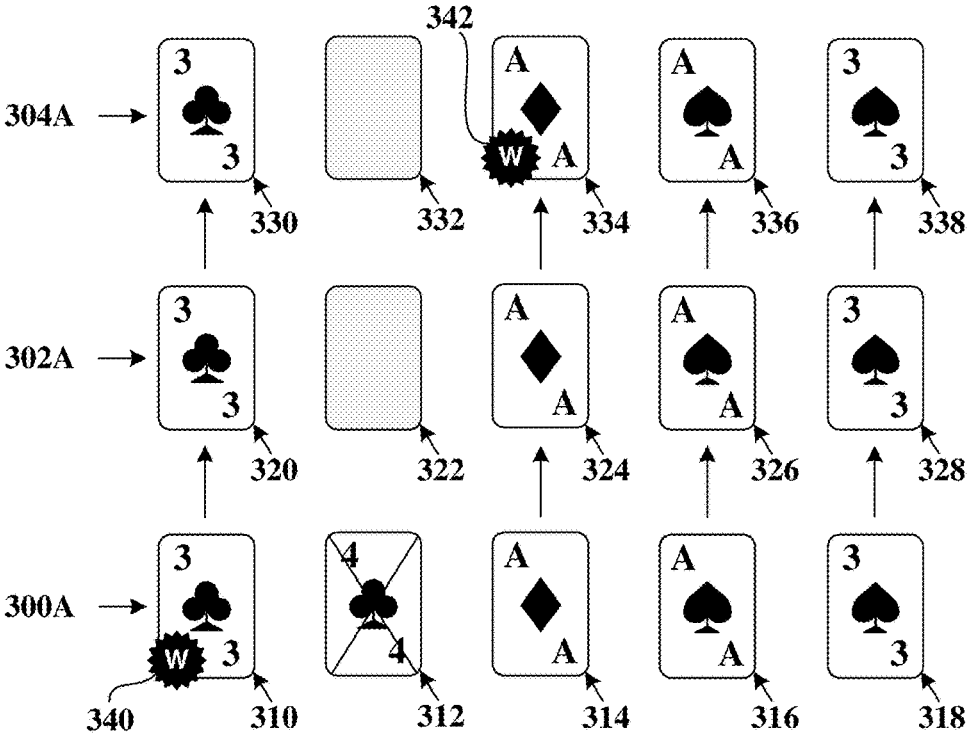
FIGS. 3A, 3B, 4A and 4B depict representative multi-play poker embodiments that identify card positions and/or card counts for card enrichment on a subsequent hand(s).
Figure 3B:
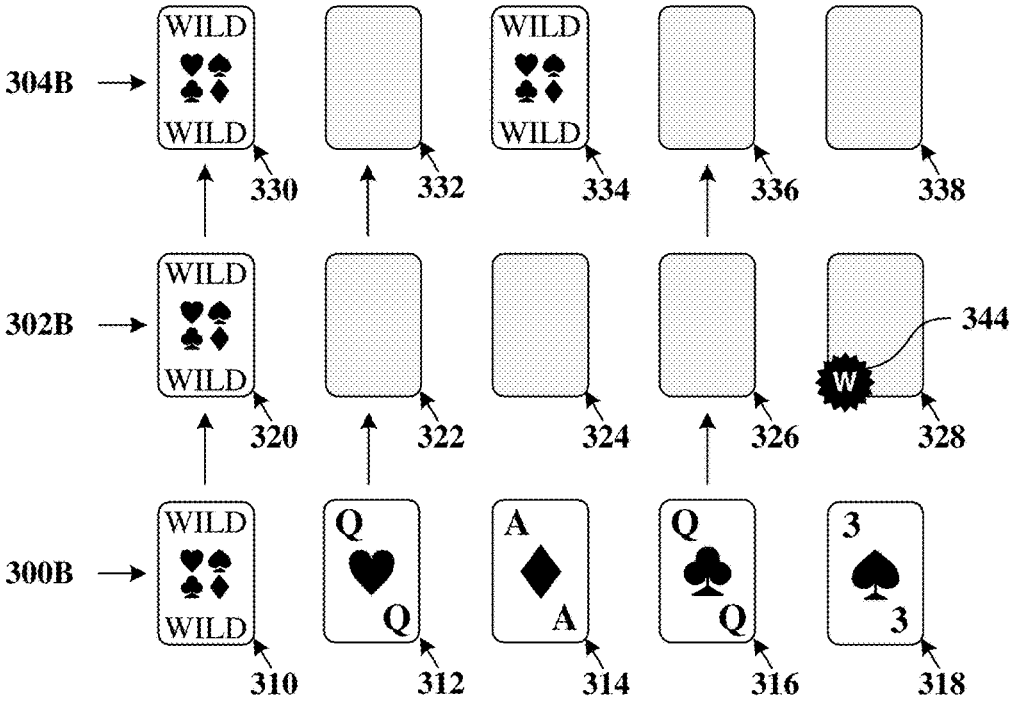

FIGS. 3A and 3B are described in the context of an electronic, multi-play, poker game embodiment. This embodiment depicts three concurrently-played hands 300A, 302A, 304A, although as few as one hand 300A could be played, and as many more than three hands 300A, 302A, 304A as desired.

FIG. 3A in this example represents a current poker game being played, that includes a first, original hand 300A, and one or more additional hands 302A, 304A. The first hand 300A is dealt, including cards 3-Clubs, 4-Clubs, Ace-Diamonds, Ace-Spades, and 3-Spades at card positions 310, 312, 314, 316 and 318 respectively. Hand 302A includes card positions 320, 322, 324, 326 and 328, while hand 304A includes card positions 330, 332, 334, 336 and 338. In accordance with one embodiment of multi-play draw poker, in which the present example assumes, cards held in one hand 300A are replicated into the other hands 302A, 304A. Other multi-play poker games may involve replicating cards into one or more other hands, but not all hands. For purposes of this example, it is assumed that cards held in the draw poker hand 300A are replicated into all of the other concurrently-played hands 302A, 304A.

In accordance with one embodiment, at any time during play of the multi-play poker event, one or more indications may be provided to designate a respective card position(s) for card enrichment, or at least potential card enrichment, on one or more subsequently played poker hands. For example, in connection with dealing the first hand 300A (whether before or after the card indicia is presented to the player), some indication, such as a sub-symbol 340, may be presented in connection with the hand 300A. This sub-symbol 340 or other indication identifies the card position 310 for card enrichment on a subsequent hand(s). Presentation of such a sub-symbol 340 or other indication might instead be presented in connection with other card positions of hand 300A, and/or in connection with other card positions of hand 302A and/or 304A.

In one embodiment, such sub-symbols or other indications may be provided in connection with one of the other hands 302A, 304A at the time the original hand 300A is dealt, or may be provided at a later time, such as if/when any cards are held from hand 300A into the hands 302A, 304A and/or if/when drawn cards replace discarded cards. In the representative example of FIG. 3A, another sub-symbol 342 was randomly provided at card location 334 of hand 304A. Thus, in a subsequent multi-play poker hand, the cards at both card positions 310 and 334 will be enhanced or otherwise provided with some benefit or potential benefit, such as being populated with a wild card, wild card with multiplier or other payout modifier (e.g., exponent, etc.), multiplier or other modifier, high value card (e.g., card rank "2" where four-of-a-kind in "2s" provides a higher payout than other card ranks), or the like, or any combination thereof.

In some embodiments, the enriched card is based on what cards are dealt in the subsequent hand(s). For example, if the subsequent hand is known to have dealt two Aces, an enriched card for that subsequent hand may be another Ace. If the subsequent hand is known to have dealt three of a particular suit, an enriched card for that subsequent hand may be another card of that suit. If the subsequent hand is known to have dealt a string of 3 or 4 consecutive cards by rank (e.g., 6, 7, 8), an enriched card for that subsequent hand may continue on that consecutive string. Thus, in some embodiments, the enriched cards in the subsequent hand are dependent on one or more, or even all, of the cards that are being dealt in the subsequent hand(s) in which the enriched cards are made available.

Providing such indications/sub-symbols 340, 342 may be provided entirely randomly. For example, card position indicators may be provided at any random time during play, whether in connection with the initial deal of the first hand 300A, and/or in connection with the initial deal of the other hands 302A, 304A of the multi-play poker game, and/or in connection with post-initial-deal activities such as in connection with a drawn card(s), etc. Alternatively, providing such indications/sub-symbols 340, 342 may be provided in connection with some event, such as a prior win, prior loss, minimum hand 300A poker rank (e.g., below some poker rank, above some poker rank, etc.), consecutive wins or losses, wager amount, or any other criteria desired to trigger the provision of one or more such sub-symbols 340, 342 or other indications. In such embodiments, the card position indicators may not be available to the player at any possible time, but rather may be provided randomly after some enabling/triggering event, such as the occurrence of some symbol(s), specific cards, a non-win on the initial deal, a non-win on drawn cards, a win on the initial deal, a win as a result of drawn cards, a number of wins in a row or within some range of hands, a number of losses in a row or within some range of hands, a time passage without a win, a sufficiently high wager, or the like. These representative examples show that the principles of identifying card positions, identifying a number of cards, identifying particular card values, or the like, may be made available always, or in a limited fashion based on time, events, etc.

The poker hands 300A, 302A, 304A of FIG. 3A may be played out to a conclusion. For example, the player chose to hold cards at card positions 310, 314, 316 and 318, resulting in those cards being replicated into hand 302A at card positions 320, 324, 326 and 328 respectively, and into hand 304A at card positions 330, 334, 336 and 338 respectively. The player chose to discard the card at card position 312 of hand 300A, and therefore replacement cards will be provided at card locations 312, 322 and 332 of hands 300A, 302A and 304A respectively.

Then, on a subsequently-played hand depicted in FIG. 3B (e.g., the next hand, or the Nth hand to follow, or the next N hands, or a random later hand, etc.), those card positions 310, 334 identified in the earlier poker play of FIG. 3A are provided with some benefit. In the illustrated embodiment of FIG. 3B, the benefit provided is a wild card. Thus, at card position 310 of hand 300B and card position 334 of hand 304B, a wild card is provided. This increases the chances of getting a winning payout and/or a higher payout amount, since the wild card represents a plurality of cards and provides multiple options for hand results. The held cards of hand 300A could be replicated into any positions of the other hands 302A, 304A.

Since the present example is described in a multi-play draw poker context (a triple-play context in this example, where three hands are played), holding a card(s) in one hand 300B causes that card(s) to be replicated and held in other hands 302B, 304B. Since a wild card has now been provided at card position 310, it is replicated into like card positions 320, 330 (but could be any positions) of the other hands 302B, 304B. In this example, the player has also chosen to hold cards at card positions 312 and 316, which would also be respectively replicated into card positions 322 and 326 of hand 302B, and respectively replicated in the card positions 332 and 336 of hand 304B (not shown).

In the illustrated embodiment, a wild card is also provided at card position 334 of hand 304B, as a result of the sub-symbol 342 (or other indication) at the card position 334 of the prior hand shown in FIG. 3A. In one embodiment, had the player held the card at card position 314, the wild card (or other enriched card) at card position 334 would be replaced by the held card from card position 314. In another embodiment, even if the player held the card at card position 314, the wild card (or other enriched card) at card position 334 would remain a wild card (or other enriched card). In still other embodiments, the better of the held card and the enriched card may be used at such position 334. In still other embodiments, still other criteria may be used to determine whether an enriched card or a newly drawn card will be used, such as using both/all enriched and newly drawn cards in separate outcomes, randomly selecting between the enriched and newly drawn cards, using the enriched or newly drawn card(s) that provides the lowest payout, using the enriched or newly drawn card(s) that provides the highest payout, using a new card based on both the enriched and newly drawn cards (e.g. if the enriched card was a "wild suit" card providing the replicated card in any suit, then the new card based on both the enriched and newly drawn cards may be the replicated card in any card suit, such as the card suit that provides or potentially provides the highest payout), etc. It should be recognized that still further examples exist of managing an enriched card on a subsequent hand that is also subject to a card replication in a multi-play poker environment, all of which may be implemented in connection with the disclosure herein to provide a desired outcome.

During this subsequent poker hand of FIG. 3B, still other sub-symbols 344 may again be presented in connection with any one or more of the card positions of any of the hands 300B, 302B, 304B, for the benefit of subsequent hands. In other embodiments, other sub-symbols such as sub-symbol 344 are not active after the initial deal, or after a card position(s) has already been identified, etc.

In one embodiment, the enriched cards may be used for more than one hand, and may be used for some number of consecutive subsequent hands, some number of nonconsecutive subsequent hands, some number of subsequent hands until some termination event occurs, etc.

In one embodiment, the sub-symbol 340, sub-symbol 342, and/or any other indication identifying respective card positions may be used to provide card enrichment with the current poker game shown in FIG. 3A. Enriching cards in a hand(s) in identified card positions of the current poker game may be done in lieu of enriching cards in a hand(s) of a subsequent poker game(s), or may be done in addition to enriching cards in a hand(s) of a subsequent poker game(s). For example, at any time during play of a current multi-play poker event as depicted in FIG. 3A, one or more indications (e.g. sub-symbols 340, 342 or other manner of identifying a card position(s)) may be provided to designate a respective card position(s) for card enrichment, or at least potential card enrichment, on one or more currently played poker hands 300A, 302A, 304A. The sub-symbol or other indication identifies the card position for card enrichment on the current hand(s). For example, sub-symbol 340 may mark card position 310 to replace the dealt 3 of Clubs with an enriched card, such as a Wild card. In such an embodiment, the current hand would benefit from the random occurrence(s) of an indication of one or more card positions to be enhanced.

In another embodiment, the card enrichment features may be used on both the current poker event and a subsequent poker event(s). For example, the sub-symbol 340, sub-symbol 342, and/or any other indication identifying respective card positions may be used to provide card enrichment with both the current poker game shown in FIG. 3A and the subsequent poker game shown in FIG. 3B. For example, at any time during play of a current multi-play poker event as depicted in FIG. 3A, one or more indications (e.g. sub-symbols 340, 342 or other manner of identifying a card position(s)) may be provided to designate a respective card position(s) for card enrichment, or at least potential card enrichment, on one or more currently played poker hands 300A, 302A, 304A of FIG. 3A, which will then also carry over to a subsequent poker game(s) such as one or more subsequently played poker hands 300B, 302B, 304B of FIG. 3B.

The sub-symbol or other indication may identify the card position(s) for card enrichment on the current hand(s), and on the subsequent hand(s). In another embodiment, the card position identified for enhancement may change from the current hand(s) to the subsequent hand(s), such as randomly changing the card positions that are enhanced in the subsequent hand(s) relative to the current hand(s), or moving the card positions that are enhanced in the subsequent hand(s) in a patterned or systematic way relative to the current hand(s) (e.g. relative to the identified card position in the current hand(s), the card position in the subsequent hand(s) moves one position to the left or right, or moves up or down to a different one of the concurrently-played hands, etc.), or the like. In another embodiment, the number of card positions to obtain enhanced cards may be changed from the currently-played hand(s) (where the enhancements may be awarded) to the subsequently-played hand(s). For example, when one card position is identified in (and an enhanced card(s) used to benefit) the currently-played poker game (e.g. FIG. 3A), two or more card positions may be identified in (and enhanced cards used to benefit) the subsequently-played poker game (e.g. FIG. 3B). This increase (or in other embodiments decrease) in card positions from a current hand to a subsequent hand may be random, based on a fixed rule (e.g. double the number of card positions of the current hand, or halve the number of card positions of the current hand, etc.), may be based on wager amount (e.g. betting one credit gets a 1:1 current-to-subsequent card position enhancement; betting two credits gets a 2:1 current-to-subsequent card position enhancement; betting three credits gets a 3:1 current-to-subsequent card position enhancement; etc.), or the like.

Thus, descriptions herein relating to benefitting a subsequent hand(s) are also applicable to embodiments where the poker game/hand in which the benefit originates (e.g. where the indication 340, 342 or other indication occurs) obtains the benefit of the enriched card(s) in addition to the subsequent hand(s) that receive the benefit. Additionally, descriptions herein relating to benefitting a subsequent hand(s) are also applicable to embodiments where the poker game/hand in which the benefit originates (e.g. where the indication 340, 342 or other indication occurs) obtains the benefit of the enriched card(s) instead of the subsequent hand(s) receiving the benefit.

In one embodiment, an additional wager or increased cost to play may be involved to qualify the player to partake in the subsequent hand benefit features described herein.

Thus, in one embodiment associated with the example of FIGS. 3A and 3B, a multi-hand poker format is implemented, where the player may make a wager for each of the concurrent hands being played and makes a wager to enable the subsequent hand card enrichment feature described herein. Sub-symbols or other indicators can be used to indicate that on the next hand (or other subsequent hand(s)) those corresponding card positions will be awarded a wild card, wild card with multiplier or other modifier, multiplier or other modifier, etc. In one embodiment, every card has a chance of obtaining a sub-symbol, and sub-symbols can be dependent on cards, could be independent and just based on card location, etc.

Figure 4A:
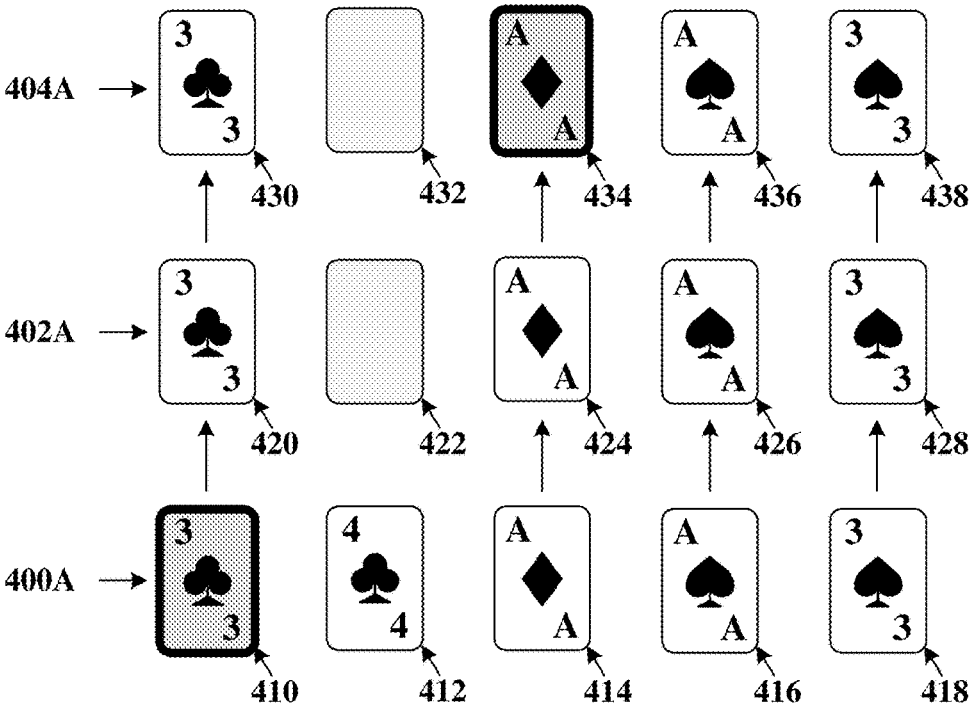
Figure 4B:
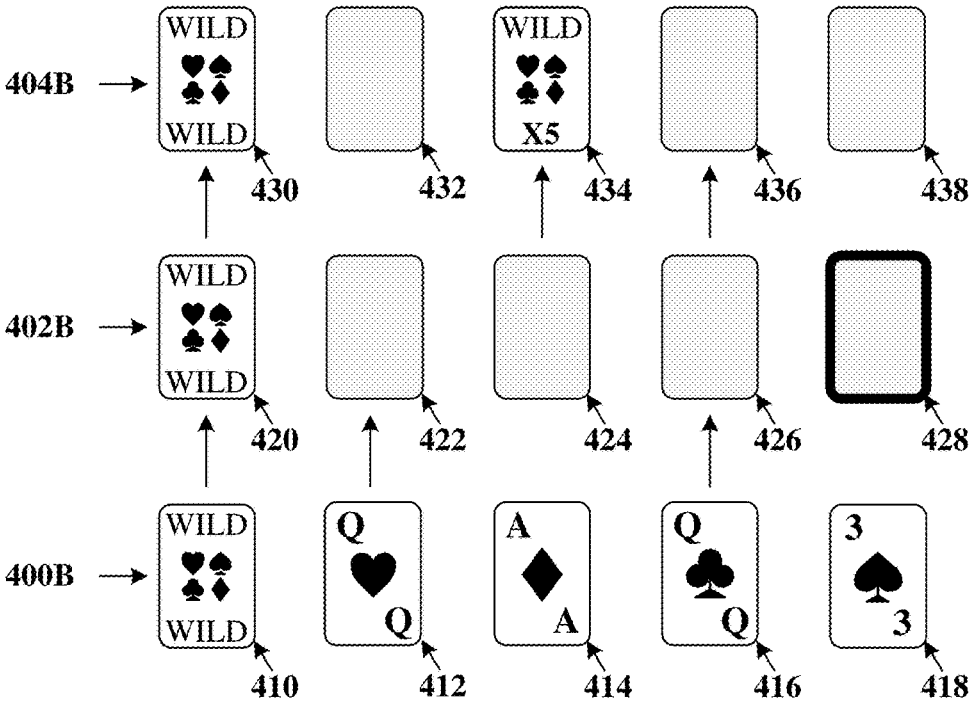

As noted herein, any type of indication(s) may be used to identify cards and/or card positions. FIGS. 4A and 4B depict another representative example of an electronic, multi-play, poker game embodiment. FIG. 4A in this example represents a current poker game being played, that includes a first, original hand 400A, and one or more additional hands 402A, 404A. The first hand 400A is dealt, including cards 3-Clubs, 4-Clubs, Ace-Diamonds, Ace-Spades, and 3-Spades at card positions 410, 412, 414, 416 and 418 respectively. Hand 402A includes card positions 420, 422, 424, 426 and 428, while hand 404A includes card positions 430, 432, 434, 436 and 438. In accordance with one embodiment of multi-play draw poker, in which the present example assumes, cards held in one hand 400A are replicated into the other hands 402A, 404A.

In accordance with one embodiment, at any time during play of the multi-play poker event, one or more indications may be provided to designate that respective card position(s) for card enrichment, or at least potential card enrichment, on one or more subsequent played poker hands, as was described in the embodiment of FIGS. 3A/3B. The example of FIGS. 4A and 4B illustrates another representative manner in which cards and/or card positions may be designated for card enrichment on a subsequent hand(s). In the example of FIGS. 4A and 4B, card positions are highlighted or otherwise emphasized to identify the card positions for subsequent card enrichment. For example, card position 410 of hand 400A and card position 434 of hand 404A are visually distinguished from other cards, to notify the player that those corresponding card positions will be allowed to receive enriched cards in a subsequent hand(s). The hands 400A, 402A, 404A may then be played out to their conclusions.

Then, on a subsequently-played hand depicted in FIG. 4B, those card positions 410, 434 identified in the earlier poker play of FIG. 4A are provided with some benefit, which are wild cards and/or wild cards with multipliers in the present example. Thus, at card position 410 of hand 400B and card position 434 of hand 404B, a wild card is provided, and the wild card at card position 434 further includes a multiplier (5X multiplier in this example). Thus, hand 404B may provide a higher likelihood of winning since wild cards are present at card locations 430 and 434, and a 5× multiplier would be applied to any resulting payout due to the wild-5× enrichment card at card location 434. Cards may be held, such as cards at card positions 410, 412 and 416, to be replicated into corresponding card positions 420, 430, 422, 432, 426, 436 of hands 402B, 404B. In other embodiments, the held cards of hand 400A could be replicated into any positions of the other hands 402A, 404A and need not be "corresponding" positions in the hands.

During this subsequent poker hand of FIG. 4B, still other card or card positions 428 may again be highlighted or otherwise emphasized to identify that new card position for card enrichment on a subsequent hand(s).

Thus, in one embodiment associated with the example of FIGS. 4A and 4B, a multi-hand poker format is implemented, where the player may make a wager for each of the concurrent hands being played and makes a wager to enable the subsequent hand card enrichment feature described herein. Mystery triggers or other random occurrences, manifested as card or card position highlighting/emphasis, can identify card positions available for card enrichment on the next hand (or other subsequent hand(s)). In one embodiment, the card locations may be highlighted at least visually, such as providing a green glow for those card locations identified for subsequent card enrichment. In one embodiment, every card/card position has a chance of being highlighted, where in other embodiments such chances are limited to some subset (e.g., the first hand 400A, etc.), whether fixed to some subset, dependent on cards played, etc.

In one embodiment, identified cards/card positions are enabled for subsequent card enrichment if the current hand includes an additional wager(s) to enable such features. In another embodiment, identified cards/card positions are enabled for subsequent card enrichment if the subsequent hand includes an additional wager(s) to enable such features. In still another embodiment, identified cards/card positions are enabled for subsequent card enrichment if both the current and subsequent hand include additional wagers to enable such features. In still other embodiments, no additional wagers are involved, and any cost is included in the standard wager to play in the game. In still other embodiments, no additional wagers are involved, but a threshold wager enables the subsequent hand card enrichment features, such as placement of a maximum wager where multiple available wager amounts are available. The principles described herein may be implemented regardless of the manner of enabling the feature, and/or where the feature is always enabled, or enabled randomly, or enabled in other desired manners.

Figure 5A:
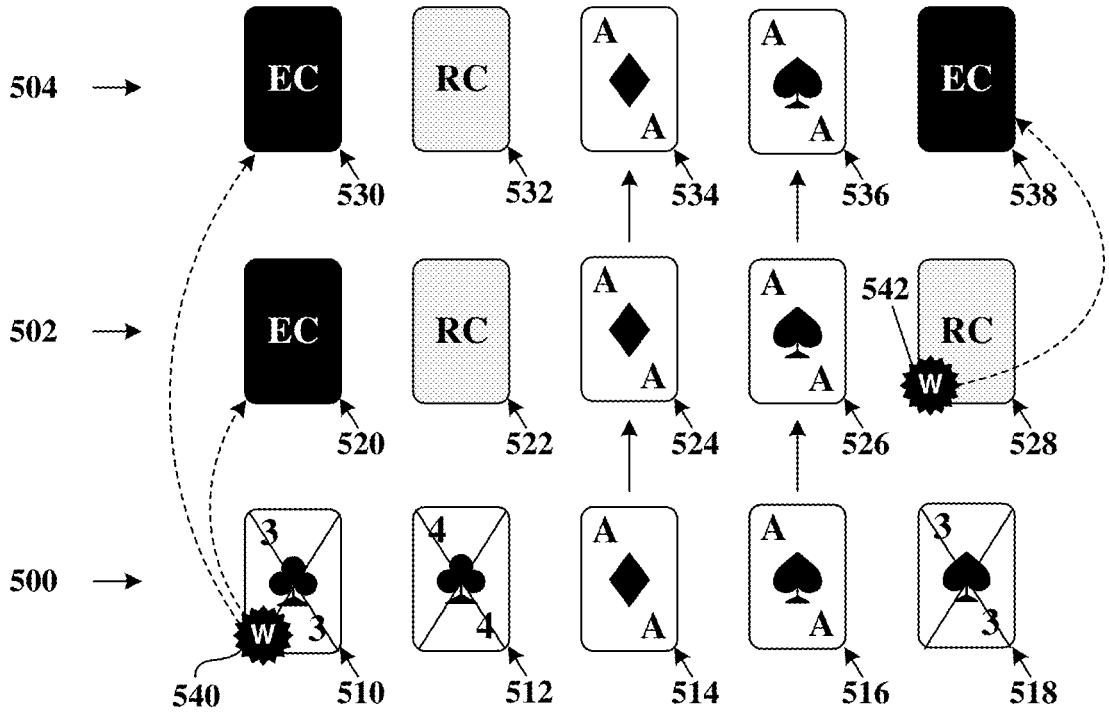
FIGS. 5A and 5B depict a representative example of a multi-play poker embodiment that enables card enrichment within the hands of the multi-play poker game or other poker/card game involving playing multiple hands.

In one embodiment, the enhancement may be provided within the multiple hands of a multi-play poker game, rather than, or in addition to, the enhancement being provided on a subsequent hand(s). FIG. 5A depicts a representative example of a multi-play poker embodiment that enables card enrichment within the hands of the multi-play poker game or other poker/card game involving playing multiple hands. In this embodiment, card positions that are marked (e.g. randomly, periodically, scheduled, etc.) will identify corresponding card positions in other hands of the multi-play poker game in which to provide enriched cards.

This example assumes a five-card multi-play draw poker game, which is a three-hand draw poker game (e.g. triple play poker) in this embodiment. However, the description herein is equally applicable to other poker variations such as multiple hand stud poker, etc. A first hand 500 is dealt, which in this example includes five cards, including the 3-Clubs, 4-Clubs, Ace-Diamonds, Ace-Spades, and 3-Spades at respective card positions 510, 512, 514, 516, 518. Card "positions" or "locations" in this disclosure does not imply a particular positioning, but rather merely references whatever position the cards are dealt to. In one embodiment, other hands 502, 504 of the multi-play poker game begin with card positions in which cards may be held into from the first hand 500, with remaining cards being filled with replacement cards (although other embodiments may involve dealing cards to the card positions of hands 502, 504). "Hand" 502 therefore may begin with card positions 520, 522, 524, 526 and 528, while a third hand 504 includes card positions 530, 532, 534, 536 and 538. In one embodiment, cards held in the first hand 500 are replicated into corresponding card positions of both (or in other embodiments at least one) other hands 502, 504.

In the embodiment of FIG. 5A, the player has received a card enrichment indicator 540 in connection with card position 510 of hand 500. In one embodiment, the cards of the next hands, namely card positions 520, 530 of hands 502, 504, will receive enriched cards (EC). In one embodiment, the card at card position 510, where the indicator 540 occurred, will also receive an enriched card. In other embodiments, the player retains the card dealt to card position 510 where the indicator 540 occurred, while the corresponding card positions 520, 530 of the respective next hands 502, 504 are targeted for the enriched cards. In one embodiment where the player retains (i.e. does not discard) the card dealt to the card position (e.g. card position 510) where the indicator 540 occurred, the player's held card is replicated into corresponding card positions 520, 530 of respective hands 502, 504, thereby overriding the use of enriched cards at the corresponding card positions 520, 530. However, in other embodiments, such as that described hereinafter for the example of FIG. 5A, it is assumed that the card at the card position 510 where the indicator 540 occurred is played independently of the targeted enriched cards (EC) at corresponding card positions 520, 530. Thus, while in this example the player has decided to discard the cards at card positions 510, 512 and 518 to obtain replacement cards from the sourcing card deck(s), the cards that will be provided at the card positions 520, 530 corresponding to the card position 510 where the indicator 540 occurred will receive enriched cards (EC).

For the other card positions where the player did not hold the dealt card (e.g. the 4-Clubs and 3-Spades at card positions 512, 518 respectively), and where no indicator (e.g. 540) is associated therewith, replacement cards will be provided to each card position from the sourcing deck(s). For example, by discarding the 4-Clubs at card position 512, new cards will be dealt to card positions 512, 522, 532, and by discarding the 3-Spades at card position 518, new cards will be dealt to card positions 518, 528, 538, as indicated by the "x-out" on cards at card positions 512, 518, and the "RC" (replacement card) at card positions 522, 532, and 528. The cards held at card positions 514, 516 are replicated into corresponding card positions of the other hands 502, 504, such that the Ace-Diamonds from card position 514 is replicated into corresponding card positions 524, 534 of hands 502, 504 respectively, and the Ace-Spades from card position 516 is replicated into corresponding card positions 526, 536 of hands 502, 504 respectively.

In one embodiment, any number of card enrichment indicators may be presented, randomly, systematically, or otherwise. Thus, in one embodiment, another card enrichment indicator 542 may be presented at any time during play, such as in connection with the initial deal, after cards have been held in a hand (e.g. hand 500), in connection with drawn cards, or any other time. In one embodiment, an indicator associated with a hand will enable a subset of the hands to be available for card enrichment, such as hands "after" the hand in which the indicator is presented. Thus, in one embodiment, the indicator 542 at card position 528 of hand 502 will allow the "next" hand (hand 504 in this example) to have its corresponding card position 538 enhanced, as depicted by the enhanced card (EC) at card position 538. In this manner, even where a card is held or subject to replacement due to a discarded card in the first hand 500, an enriched card(s) can impact at least one more hand. In yet another embodiment, the card enrichment can "wrap around," such that a card enrichment indicator 542 at card position 528 of the $2^{nd}$ hand 502 would cause card position 538 of hand 504 to be enriched, and wrap around to cause card position 518 of hand 500 to be enriched, or provide the possibility or option to be enriched.

Figure 5B:
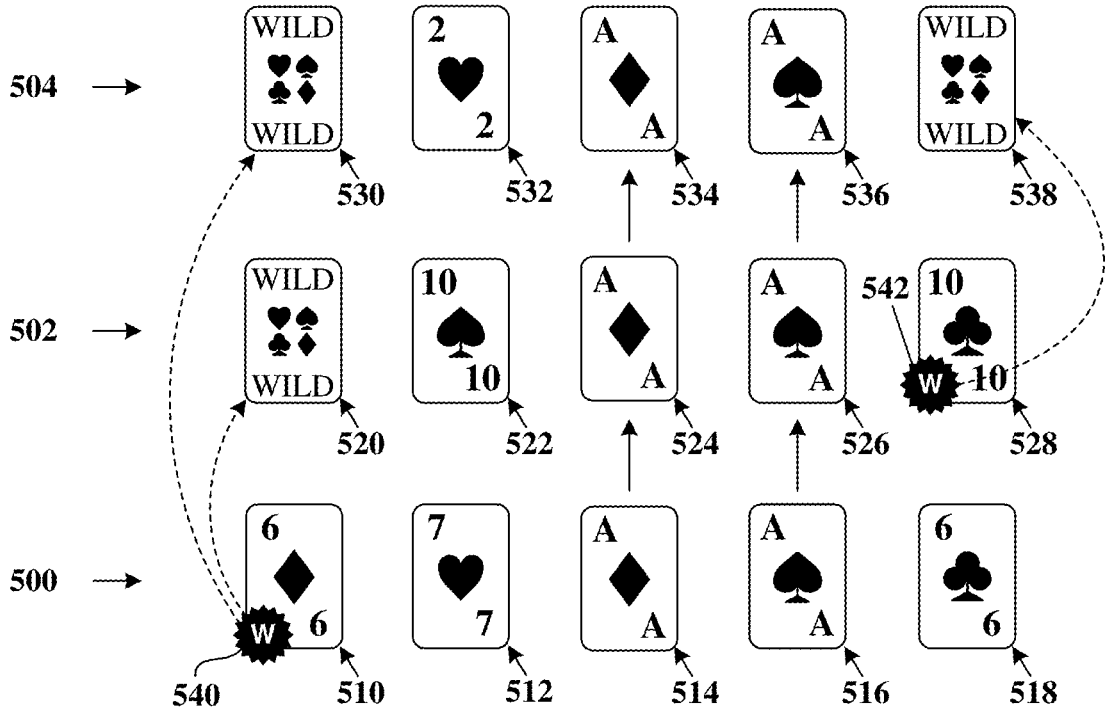

Using the same reference number as in FIG. 5A, FIG. 5B depicts an example of resulting final hands in which payouts may be determined. In the example of FIG. 5B, card positions identified for enriched cards (EC) in FIG. 5A are changed to wild cards, card positions available to receive replacement cards (RC) are provided with new replacement cards (e.g. from the sourcing virtual/electronic decks or elsewhere), cards from card positions 510, 512 and 518 which are discarded are also provided with new replacement cards, and held cards from card positions 514, 516 are replicated into corresponding card positions of the remaining hands 502, 504. Thus, in the example of FIG. 5B showing final hands for the hands presented in FIG. 5A, the player obtains two pair (Sixes and Aces) for hand 500, a full house (three Aces and two Tens, with the Wild card serving as one of the Aces) for hand 502, and four-of-a-kind (four Aces, with two Wild cards serving as two of the Aces) for hand 504. In one embodiment, those cards marked with card enrichment indicators may also mark card positions for one or more subsequent multi-play poker hands to enable further card enrichment.

Figure 6:
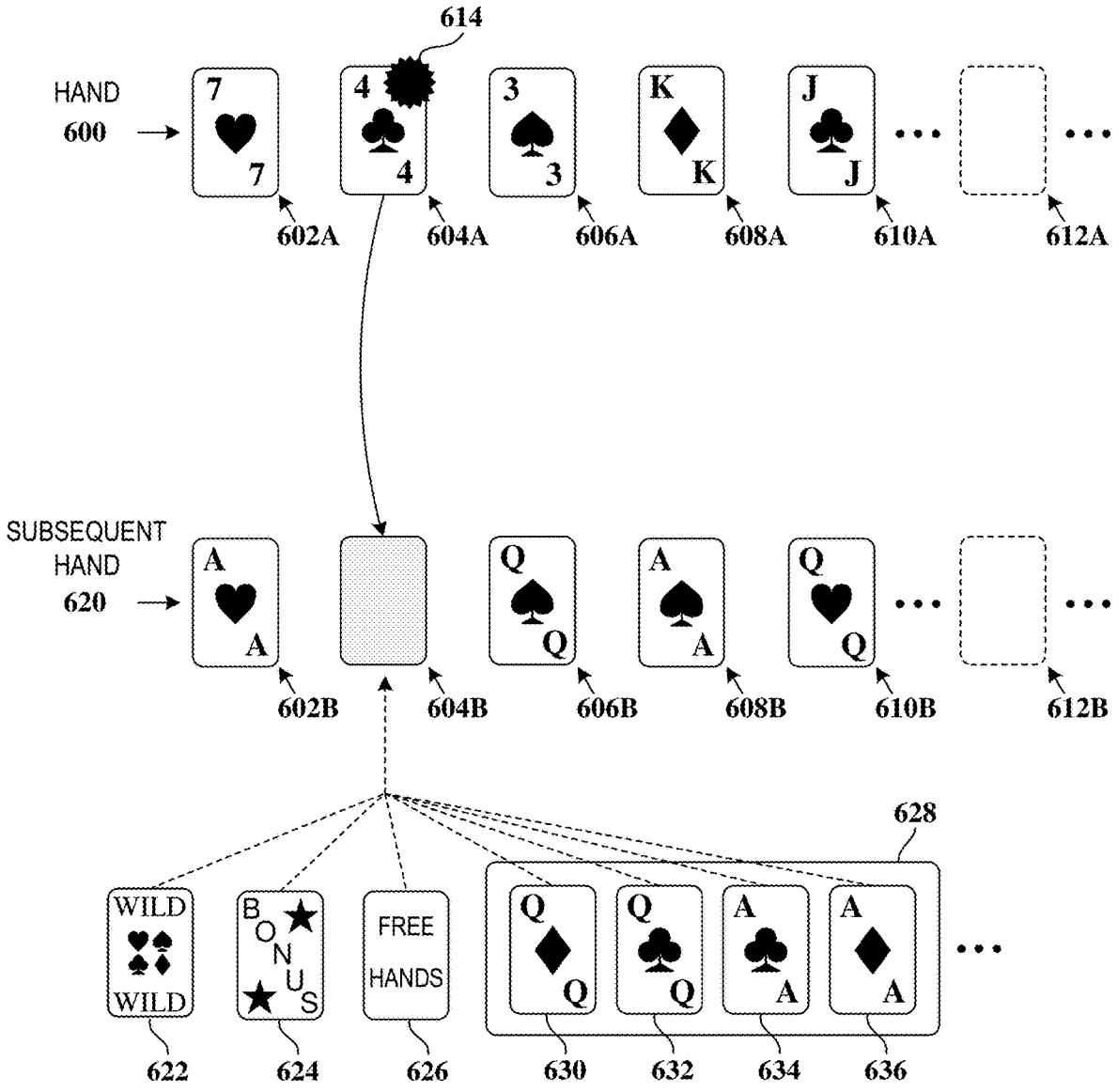
FIG. 6 depicts a representative single-play poker embodiment that identifies card positions and/or card counts for card enrichment in a subsequent poker hand(s).

FIG. 6 depicts a representative single-play poker embodiment that identifies card positions and/or card counts for card enrichment in a subsequent poker hand(s). As noted previously, the principles described herein are applicable in single-play games or multi-play games, such as single-hand poker or multi-hand poker, etc. The example of FIG. 6 depicts a single-hand poker game, which may be a single-hand stud poker, draw poker, or other poker game.

A first hand 600 may represent any dealt poker hand, such as a hand in stud poker, an initial hand in draw poker, or the like. In the example of FIG. 6, sub-symbols identify the card positions for subsequent card enrichment, although any manner of identifying card positions may be employed. In this example, a hand of five cards is dealt to card positions 602A, 604A, 606A, 608A, 610A. In games where there are fewer than five cards, then one or more of the card positions 602A, 604A, 606A, 608A, 610A would not be dealt to. In games where there are more than five cards, then one or more additional cards may be dealt to respective card positions 612A. In the present example, the poker game involves an initial deal of five cards, including the 7-Hearts, 4-Clubs, 3-Spades, King-Diamonds, and Jack-Clubs at card positions 602A, 604A, 606A, 608A, 610A respectively.

In the illustrated embodiment, an indicator 614, depicted as a sub-symbol, overlay, and/or other perceivable designation, is randomly positioned to identify card position 604A as a designated card position for subsequent hand enrichment. Different or additional card positions 602A, 606A, 608A, 610A, etc. may have alternatively and/or additionally been identified, and in still other hands no such card positions may be identified. In the illustrated embodiment, card position 604A is identified via sub-symbol 614, thereby notifying the player that the corresponding card position will be allowed to receive an enriched cards in a subsequent hand(s). The hand 600 may then be played out to its conclusion.

On a subsequently dealt hand 620, such as the hand immediately subsequent to played hand 600 in one example, the card position 604B is reserved for an enriched card based on the earlier hand 600 obtaining the indicator 614 at the corresponding card position 604A. As indicated elsewhere herein, the enhanced card that will occupy the identified card position 604B may be any card that can enhance the resulting hand 620. In one embodiment, such enhanced card provided to the enhanced card position 604B is designed to give the resulting hand 620 a higher probability of obtaining a winning result and/or a higher probability of getting a greater payout than if a card was randomly selected from the sourcing deck(s) of cards. Such enhanced cards may be any of, by way of example and not of limitation, a wild card 622 (which may or may not include additional enhancements, e.g. multipliers or other payout modifiers), bonus card 624 (e.g. a card that enables reaching a bonus event, or directly provides a credit or other award bonus, etc.), a free hands card 626 providing the player with one or more hands to play without providing additional player assets or providing less player assets, and/or other card that may prove beneficial to the play of the subsequent hand 620.

In one embodiment, the enhanced card is dependent on the state of one, more, or all of the other cards dealt to the subsequent hand 620. Such a situation-dependent card may be a particular card, or may be selected from a pool 628 of cards, that has a particular ability to help the subsequent hand 620 obtain a winning result and/or a higher payout. In the example of FIG. 6, the subsequent hand 620 includes an Ace-Hearts, Queen-Spades, Ace-Spades, and a Queen-Hearts at card positions 602B, 606B, 608B and 610B respectively. In this representative embodiment, another Queen or another Ace would allow the subsequent hand 620 to obtain a full house, which is the highest resulting subsequent hand 620 possible in view of the dealt cards at card positions 602B, 606B, 608B and 610B. In this embodiment, any of the Queen-Diamonds 630, Queen-Clubs 632, Ace-Clubs 634 and Ace-Diamonds 636 of the card pool 628 will cause the subsequent hand 620 to obtain a full house.

In one embodiment, the cards available in the card pool 628 may provide one or more "good" cards, the "best" card, multiple "best" cards, etc. For example, a "good" card might be one that provides a winning result, but not the best possible result (e.g. a card that completes a flush, but not a straight flush). Thus, the enhanced card may be randomly selected among one or more such "good" cards and provided to the player, or may select the best card of those randomly made available, or the player may be allowed to select from a plurality of cards that will provide a winning result, etc. As another example, the "best" card may be used to enhance the card position 604B, such as a wild card 622 that represents any card, or a special card that provides a jackpot, etc. Thus, it should be recognized that the description herein contemplates embodiments such as the enriched cards being the best card(s) possible, a good card(s) but not necessarily the best card(s) possible, a specialty card(s) such as a wild card 622, bonus card 624, free hands card 626 and/or other card to ensure or at least increase the probability of a win and/or higher payout, and/or any other desired card to enrich or potentially enrich the player's subsequent hand(s) 620.

In still other embodiments, the card pool 628 may include a plurality of cards that will be used in a corresponding plurality of the cards 602B, 604B, 606B, 608B, 610B of the subsequent hand 620. In such an embodiment, this plurality of cards serves as a subset of at least one potentially winning resulting hand. For example, the plurality of cards may include three-of-a-kind, which, while already providing a payout in this example for three-of-a-kind, serves as a subset of four-of-a-kind, which may be a higher paying resulting hand. Thus, in some embodiments, a plurality of beneficial cards serving as a head start to, or otherwise providing some degree of progress towards, a resulting hand that may be of heightened interest to the player, either due to a more likely win, a higher paying win, etc. The particular cards forming the such a plurality of cards in the card pool 628 may be made known to the player prior to their use, such as in connection with play of the hand 600 giving rise to the subsequent hand 620 enhancement (e.g. written or otherwise identified on the sub-symbol 614 and/or other overlay, table of identifiers and corresponding plurality of cards, pop-up, second display, etc.), or the player may be made known of the impending enhancement by way of an indicator (e.g. sub-symbol 614) during play of the hand 600 but not the actual card values until the subsequent hand 620 is played, or other timing as desired. Additional embodiments involving providing multiple, particular cards in a subsequent hand as a result of an enhancement award notification in a current or earlier hand are described later in this description.

As noted herein, the principles described herein are applicable to any poker game, as well as other card games, and other gaming activities. In the poker context, the example of FIG. 6 (and other poker embodiments) may involve stud poker that does not involve discarding and drawing replacement cards, may involve draw poker with does involve discarding and drawing replacement cards, hold'em poker where initial "hole" cards and/or community cards are subject to the subsequent hand enhancement, 3 Way Action® poker (using both stud and draw poker portions), and other poker variations. For example, in the example of FIG. 6, a five-card stud poker embodiment may involve dealing five cards to the hand 600 depicted at card positions 602A, 604A, 606A, 608A, 610A, where an indicator 614 indicates that a card at card position 604B of a subsequent hand 620 is available for enhancement.

A seven-card stud poker embodiment may involve dealing seven cards to the hand 600 depicted at card positions 602A, 604A, 606A, 608A, 610A through a seventh card position depicted by card position 612A, where an indicator 614 indicates that a card at card position 604B of a subsequent hand 620 is available for enhancement. In one seven-card stud poker embodiment, the best five of seven cards are used in the final resulting hand, where one embodiment involves allowing the identified card position (e.g. card position 604A identified by sub-symbol 614) of the hand 600 to be available for enhancement in the subsequent hand 620 regardless of whether the card at the identified card position is used in the first hand 600. Another seven-card stud poker embodiment involves allowing the identified card position (e.g. card position 604A identified by sub-symbol 614) of the hand 600 to be available for enhancement in the subsequent hand 620 only if the card at the identified card position is used in the first hand 600.

A draw poker embodiment may involve allowing the player to discard a number of cards of the hand 600, and obtain replacement cards. In one embodiment, the indicator(s) 614 may appear before the initial deal, in connection with the initial deal, in connection with discarding cards, in connection with obtaining replacement cards, etc. In one embodiment, regardless of when the indicator(s) 614 is provided, a corresponding card position in the subsequent hand 620 is identified for card enhancement. In one embodiment, the subsequent hand 620 may allow enhanced cards to be discarded and replaced by the player in a draw poker embodiment. In another embodiment, the subsequent hand 620 uses an enhanced card and does not afford the player an opportunity to discard and replace the enhanced card.

In other embodiments, an enhanced card (e.g. 622, 624, 626, 628) may additionally (or instead) be provided in the hand 600 in which the benefit originated. For example, in one embodiment, the indicator 614 designates card position 604A of a current hand 600 to receive an enhanced card, and designates a corresponding card position 604B of a subsequent hand 620 to receive an enhanced card, which may be the same or different enhanced card between the identified card positions of the hands 600, 620.

It should be recognized that by enhancing a "card position," the exact position of the card need not correspond. Rather, by "card position" it is meant that a card in the first of five card positions (for example) in one hand would correspond to a card in the first of five card positions in a subsequent hand, and the particular placement or whereabouts may be irrelevant. Further, while some embodiments correlate the particular card position from a first hand to a subsequent hand, the card position (e.g. which card position of those dealt) need not be the same in other embodiments. For example, if a card position is marked for enhancement in a first hand, a different card position may be the one enhanced in the subsequent hand. Thus, descriptions relating to utilizing a corresponding card position from one hand to a subsequent hand are equally applicable to enhancing any card(s) of the subsequent hand if the earlier hand indicated that the number of cards is to be enhanced. In such embodiments, card positions themselves would not need to be marked (although could be), but a number of cards to be enhanced in a subsequent hand may be randomly indicated in the earlier hand in any manner, including simply indicating a number (e.g. two) of cards to be enhanced in the subsequent hand.

Figure 7:
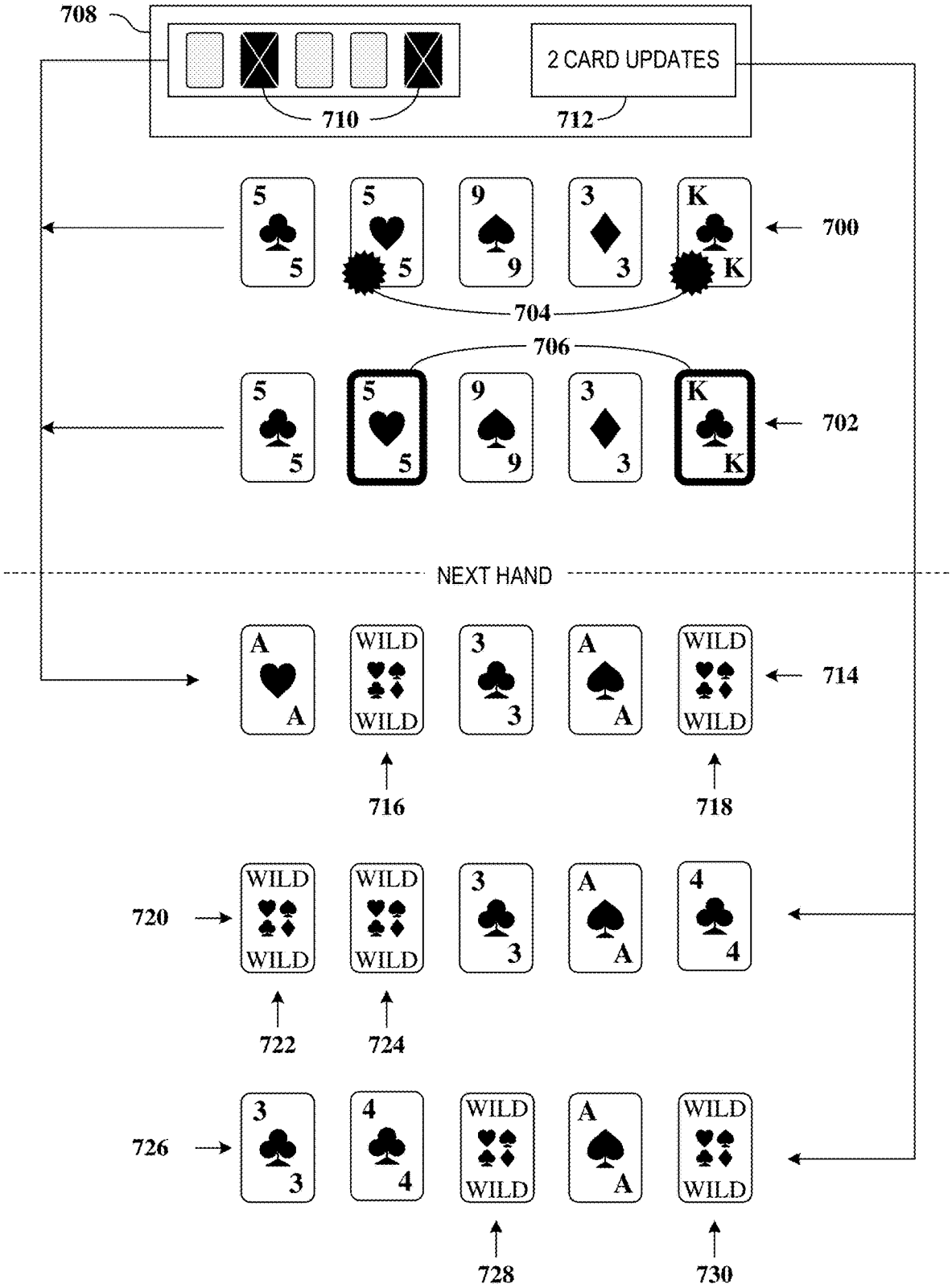
FIG. 7 illustrates representative examples in which card positions may be identified for card enrichment on subsequent hands.

As previously noted, card positions where enriched cards are provided in subsequent hands may correspond to the card positions of the current hand in which the card enrichment feature was awarded. In still other embodiments, particular card positions need not be carried over to the subsequent hands. FIG. 7 illustrates representative examples in which card positions may be identified for card enrichment on subsequent hands.

Poker hands 700 and 702 represent current hands using sub-symbols 704 and highlighting 706 respectively, as described in connection with FIGS. 3A/3B and 4A/4B respectively. The sub-symbols 704, highlights 706, and/or any other identifying indicia or distinctions, may be randomly presented at random times and associated with random card positions.

In another embodiment, a display 708 may present card locations for one or more hands 700, 702, depicting card locations 710 in which the card enrichment on subsequent hands may be provided.

For embodiments such as the use of sub-symbols 704, highlighting 706, depicted card locations 710, or other position-identifying implementations (including approximate position designations versus specific position designations), cards in a subsequent hand (the next hand 714 in this example) will be enriched or otherwise modified at the designated card positions 716, 718, as shown at next hand 714.

Some embodiments involve identifying approximate positions in which the card enrichments will occur, rather than specific card positions. For example, a designation may indicate to enrich any card in the original/first hand, or in the second hand, or any of the first three cards in any of the hands, etc.

As poker hands may not be card-order-dependent, other embodiments do not necessarily identify specific card positions, but rather identify a quantity of cards subject to card enrichment on a subsequent hand(s). For example, the display 708 may identify some number of card updates 712 that will be available for card enrichment on a subsequent hand. In the illustrated embodiment of FIG. 7, the display 708 presents card updates 712 indicating that two cards should be enriched on the next hand. For such embodiments, the cards to be updated may be determined by rules, may be determined randomly, may be selected by the player, may be a particular subset of a winning hand (e.g. four cards of a Royal Flush), may be selected from a group of winning hand subsets (e.g. X cards to a particular winning result), etc. The next hand 720 shows the first two cards 722, 724 as the designated card enrichment positions, which in the illustrated embodiment may be identified by rule, such as to enrich cards in the quantity identified from left to right.

Another representative next hand 726 illustrates an example where card positions 728, 730 are designated randomly. In another embodiment, the player may select which card position should have the card enrichment.

As noted above, activity outside of the card play area may also cause the card enrichment feature to trigger, versus, for example, a random trigger. Another example is that a pair of dice or a die is rolled, and the number shown is the number of locations awarded for card enrichment. Alternatively, a wheel could be spun which determines the number and/or locations of card enrichment for a future game(s). These and other manners of determining which of the card positions are to house the enriched cards may be implemented.

In another embodiment, rather than card positions being identified, cards having certain characteristics (e.g., an 8 of Hearts) may identify its card position as one for card enrichment on a subsequent hand(s). For example, cards having a certain suit and/or rank may trigger the card enrichment feature. As a more particular example, it could be defined that when an "8" card is presented during play, that card position is marked for card enrichment on a future hand. In another particular embodiment, an 8 of Hearts or other particular card may serve as the trigger, whereby a maximum of one card enrichment for a subsequent hand could be awarded in a single-deck poker variant.

Cards can be enriched in any desired manner. Wild cards provide an enrichment, as the card may be defined to represent any card of the virtual deck (e.g. the electronically stored source of cards for the poker games), or at least any remaining card of the virtual deck that is not already presented as part of the poker hand. Multipliers or other modifiers may represent an enrichment, in that multipliers/modifiers can increase payouts to the player. Wild cards that also have a multiplier/modifier associated therewith provide the double benefit of increasing the chances of obtaining a winning payout, as well as offering an opportunity to increase one or more of the payouts occurring in connection with the poker hand. Enriched cards could be split cards, where multiple cards may represent a position, which is also described U.S. Pat. No. 8,323,085, entitled "Method And Apparatus For Increasing Potential Payout Opportunities In Card Games," issued Dec. 4, 2012, the content of which is hereby incorporated by reference in its entirety. Enriched cards may also include cards with credit values associated therewith, or any other card configuration providing an advantage over the card had it not been enriched.

Figure 8:
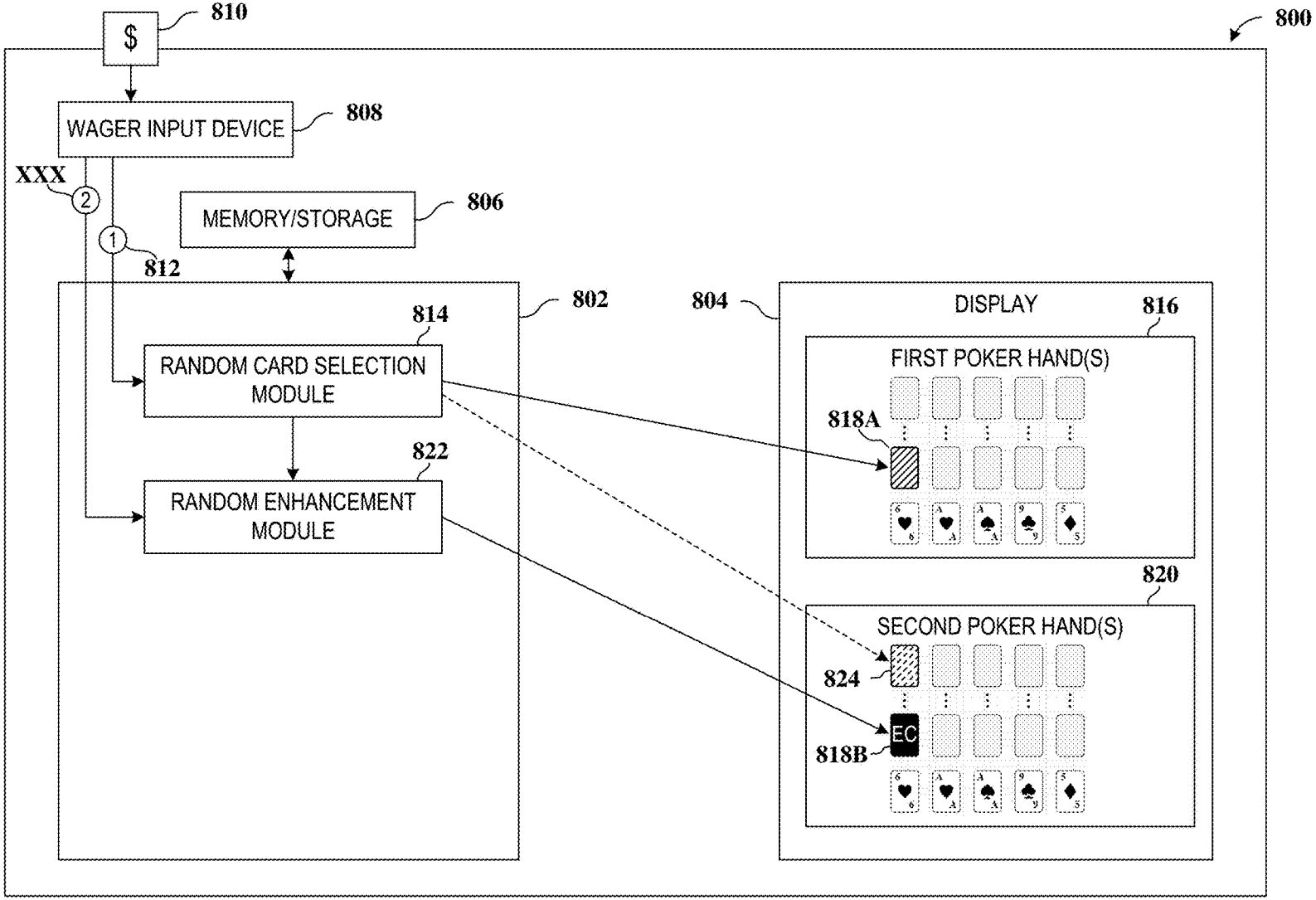
FIG. 8 depicts a representative structural example where structural components interoperate to provide subsequent hand enrichment in accordance with the disclosure.

FIG. 8 depicts a representative structural example where structural components interoperate to provide subsequent hand enrichment in accordance with the disclosure. A gaming system 800 includes at least a processor 802 (which may include one or more discrete components, local or distributed, etc.) and a display 804. A memory and/or storage 806 may store programs or other code that is executable by the processor 802. The memory/storage 806 may also store game information such as current cards in hands, card positions designated for subsequent card enrichment, enriched card values, etc. A wager input device 808 may be provided to accept player assets 810, which in one embodiment enables the player to participate in the poker games. In one embodiment, the wager input device 808 accepts sufficient player assets for more than one poker game/hand, and the processor 802 allocates player assets to a first poker hand(s) 816 if the player provided the player assets to play it (whether by adding new player assets, allocating banked player assets, etc.), and allocates player assets to a subsequent poker hand(s) 820 if the player provided the player assets to play that subsequent poker hand(s) 820 (whether by adding new player assets, allocating banked player assets, etc.)

In one embodiment, participation in a first hand 812 utilizes a random card selection module 814, which may include a processable program stored in memory/storage 806 and executable by the processor 802. In this embodiment, the random card selection module 814 at least identifies whether or not any card positions of the first poker hand(s) 816 presented via the display 804 will be randomly designated as approved for subsequent hand enrichment, and if so, the quantity and particular card positions. In the example of FIG. 8, the random card selection module 814 may implement a random number generator or other module to randomly select card position 818A as approved for subsequent card enrichment.

The processor 802 may facilitate continued play of the first poker hand(s) 816 through its/their completion. At some point, such as after completion of the first poker hand(s) 816 (or during play of the first poker hand(s) in other embodiments), the player is enabled to play a second poker hand(s) 820 presented again on the display 804. The second poker hand(s) 820 may be displayed, for example, on a separate display section of the display 804, or on the same display section of the display 804 after the first poker hand(s) are complete, etc.

For the second poker hand(s) 820, since a card position 818A was designated for subsequent hand enrichment in the first poker hand(s) 816, that corresponding card position 818B in the second poker hand(s) 820 is dealt an enriched card (EC). For example, in a multi-play poker environment, if the first card position 818A of the second row/hand of cards in the first poker hands is designated as a card position for subsequent hand enrichment, then the first card position 818B of the second row/hand of cards in the second poker hands 820 receives an enriched card.

The random enhancement module 822 represents a programmed module, such as code stored in the memory/storage 806 and operable via the processor 802, that provides the enriched card at the designated card position 818B. The random enhancement module 822 may also determine what the enriched card will be. In one embodiment, there may be no such decision, but rather the enriched card may always be the same, such as a Wild card representing any desired card. In other embodiments, the random enhancement module 822 may select the enriched card from a set of available enrichment cards (e.g. Wild cards; Wild cards with a multiplier; Wild cards with other modifiers; standard deck cards but with a multiplier or other modifier associated therewith, etc.).

In still other embodiments, the random enhancement module selects the enriched card based on the cards that are dealt to the second poker hand(s) 820. For example, if the second poker hand(s) 820 includes a five-card hand with three Aces, the random enhancement module may determine which card will provide the best outcome given three existing Aces, such as assigning the enrichment card as another Ace. In still other embodiments, the random enhancement module 822 may identify a plurality of possible "good" cards for a particular hand of the second poker hand(s) 820, and automatically select one of such cards. In another embodiment, the player may be allowed to select among such a plurality of possible "good" cards, where in one embodiment the player is allowed to see the plurality of cards face-up and make the selection, where in other embodiments the player selects from such plurality of cards without knowledge of the card suit/rank—i.e. fact down. The random enhancement module 822 may provide these and other manners of providing an enriched card at the card position(s) 818B corresponding to that which was previously designated as a card position 818A available for subsequent enrichment.

The process of potentially designating zero, one, or more card positions in any hand of a poker play/game may continue to third poker hands, fourth poker hands, etc. This is depicted by the random card selection module 814 again identifying a card position(s), card position 824 of the second poker hand(s) 820 in this example, as a card position that will be available for card enrichment in another subsequent poker hand, such as a third poker hand(s) (not shown). Thus, the poker enrichment structure and methodology may be used for still further hands as the player plays the poker games.

Figure 9:
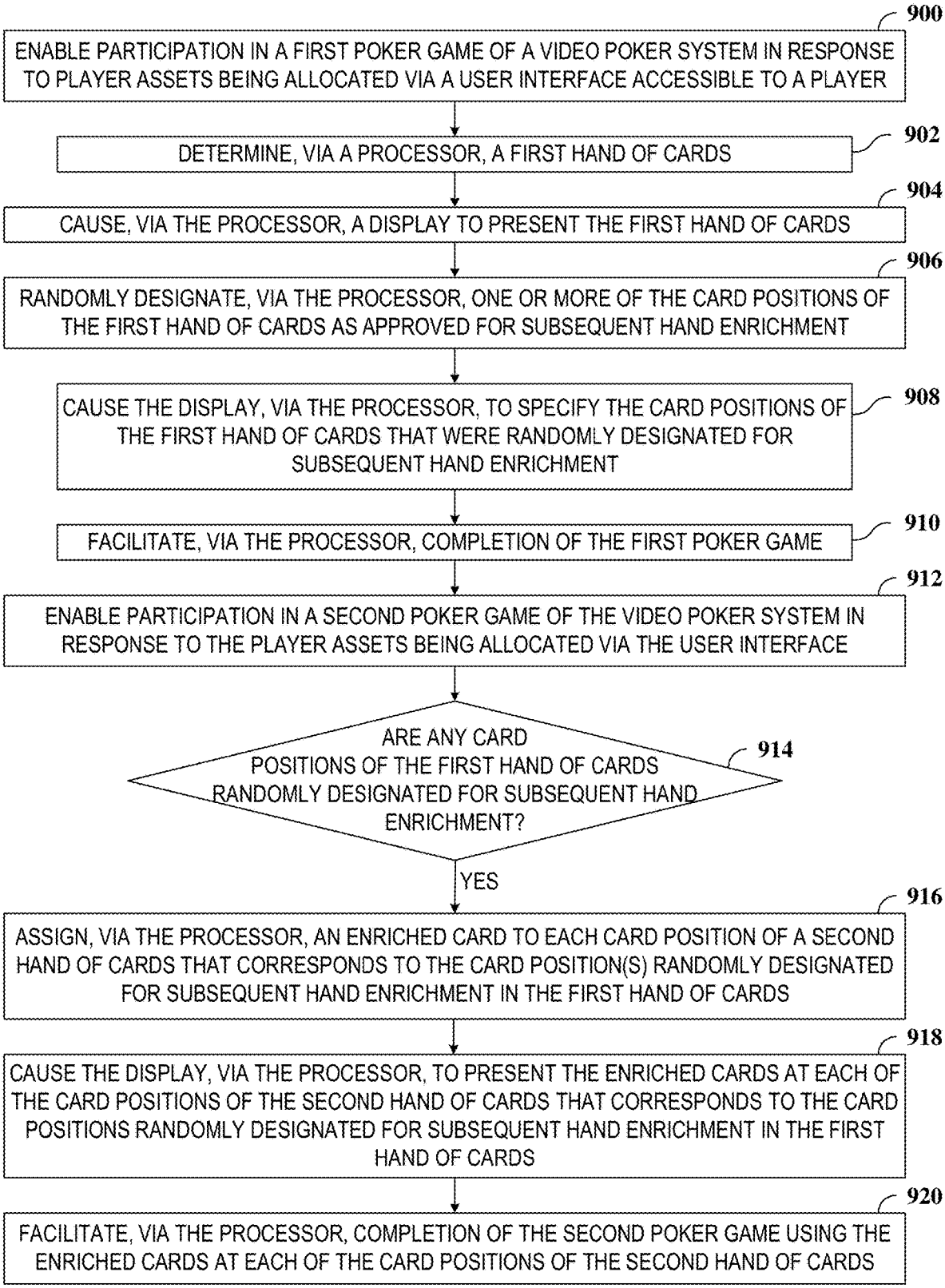
FIG. 9 is a representative structure-facilitated method for providing subsequent hand card enrichment for poker games.

FIG. 9 is a representative structure-facilitated method for providing subsequent hand card enrichment for poker games, which is also analogously applicable to other games involving at least consecutive games with gaming symbol positions. In this representative method of operating a video poker system, participation in a first poker game is enabled 900 in response to player assets being allocated via a user interface accessible to a player, and in response thereto, the processor determines 902 a first hand of cards. The processor causes 904 a display to present the first hand of cards. The processor randomly designates 906 one or more of the card positions of the first hand of cards as being approved for subsequent hand enrichment, and also causes 908 the display to specify the card positions of the first hand of cards that were randomly designated for subsequent hand enrichment.

The processor facilitates 910 completion of the first poker game, and enables 912 participation in a second poker game of the video poker system in response to the player assets being allocated via the user interface. If there are any card positions of the first hand of cards randomly designated for subsequent hand enrichment as determined at decision block 914, then the processor may assign 916 an enriched card to each of the card positions of a second hand of cards of the second poker game that corresponds to the card positions randomly designated for subsequent hand enrichment in the first hand of cards. In such case, the processor may cause 918 the display to present the enriched cards at each of the card positions of the second hand of cards that corresponds to the positions randomly designated for subsequent hand enrichment in the first hand of cards, and may further facilitate 920 completion of the second poker game using the enriched cards at each of the one or more card positions of the second hand of cards. In one embodiment, if no card positions of the first hand of cards randomly designated for subsequent hand enrichment as determined at decision block 914, then completion of the second poker game is accomplished using randomly selected cards of the virtual deck(s), without any enriched cards (not shown).

Figure 10:
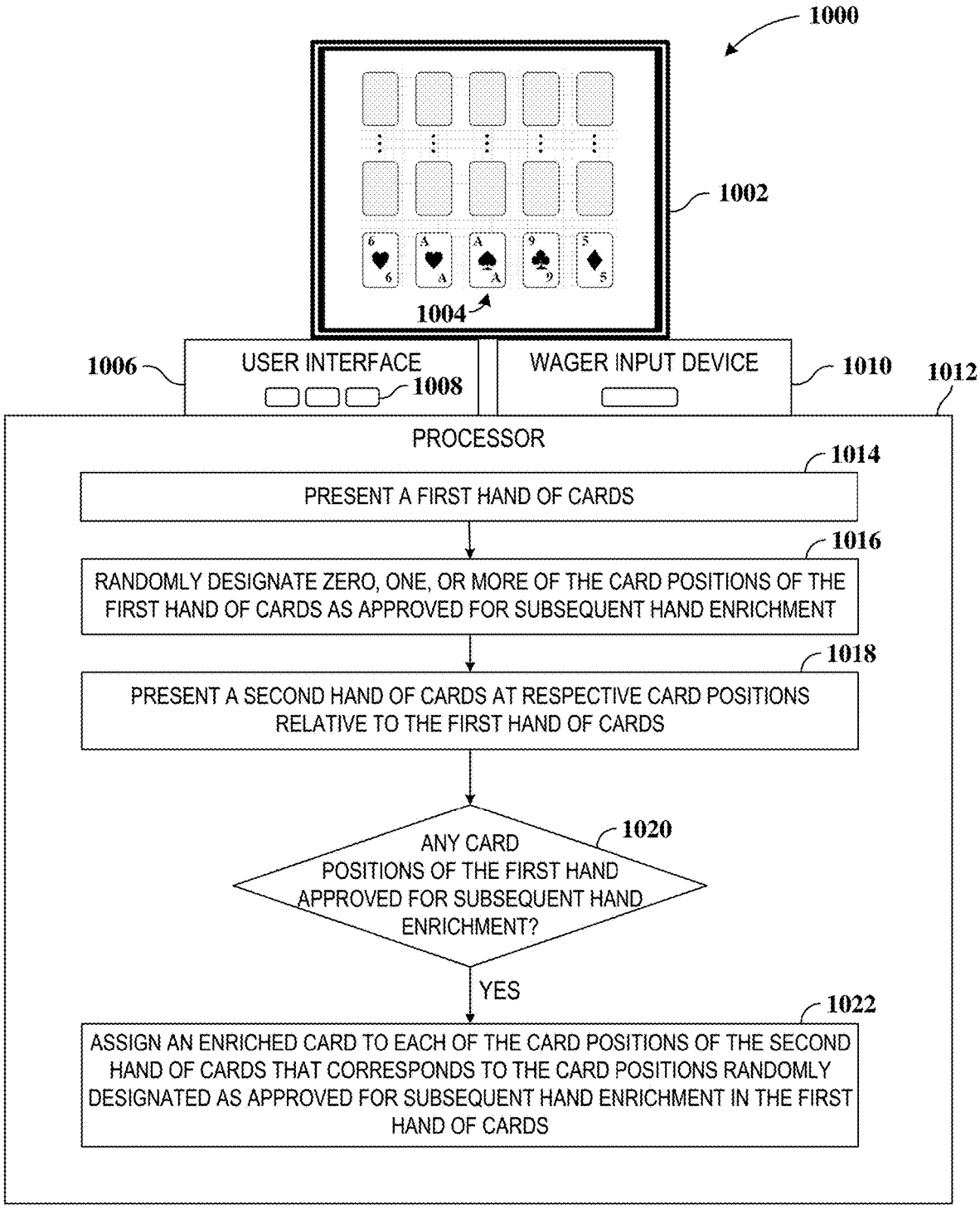
FIGS. 10 and 11 depict block diagrams of representative gaming systems for enriching subsequent poker hands based on card position designations in prior poker hands.

FIG. 10 is a block diagram of a representative gaming apparatus for enriching subsequent poker hands based on card position designations in prior poker hands. In the embodiment of FIG. 10, a gaming device 1000 for playing a poker game is provided.

The representative gaming device 1000 includes at least a display(s) 1002 presenting a single or multiple poker hands 1004. A user interface 1006 is provided that includes at least one user input 1008 to enable a player to initiate and participate in poker hands 1004 presented via the display 1002. A wager input device 1010 may be provided, which may be structured to identify and validate player assets and ultimately permit the player to play the poker game events when the player assets are provided. For purposes of illustration, the present example is described in terms of a single-hand poker game, although the principles are equally applicable to multi-play poker, such as a triple-play poker game, where multiple poker hands are presented to the player at one time, and where cards held in one hand are replicated into all of the other concurrently-played hands.

A processor 1012 is configured to, in one embodiment, present 1014 a first hand of cards, such as by causing the display 1002 to present 1014 the first hand of cards. In one embodiment, this presentation 1014 is made available in response to player assets being allocated via the wager input device 1010, or via the user interface 1006 in other embodiments. The processor is configured to randomly designate 1016 zero, one or more of the card positions of the first hand of cards as approved for subsequent hand enrichment. For example, for some poker game deals, the processor might not designate 1016 any card positions of the first hand of cards (which again, may be a single hand, or multiple hands in a multi-play environment) for subsequent hand enrichment, where in other embodiments one or more card positions may be so designated 1016.

In the illustrated embodiment, the processor 1012 presents 1018, such as causing the display 1002 to present 1018, a second hand of cards at respective card positions in response to the player assets being allocated via the wager input device 1010 to participate in the second hand of cards. If, as determined at decision block 1020, one or more of the card positions of the first hand of cards were randomly designated as approved for subsequent hand enrichment, the processor 1010 assigns 1022 an enriched card to each of the one or more card positions of the second hand of cards that corresponds to the one or more of the card positions randomly designated as approved for subsequent hand enrichment in the first hand of cards.

Figure 11:
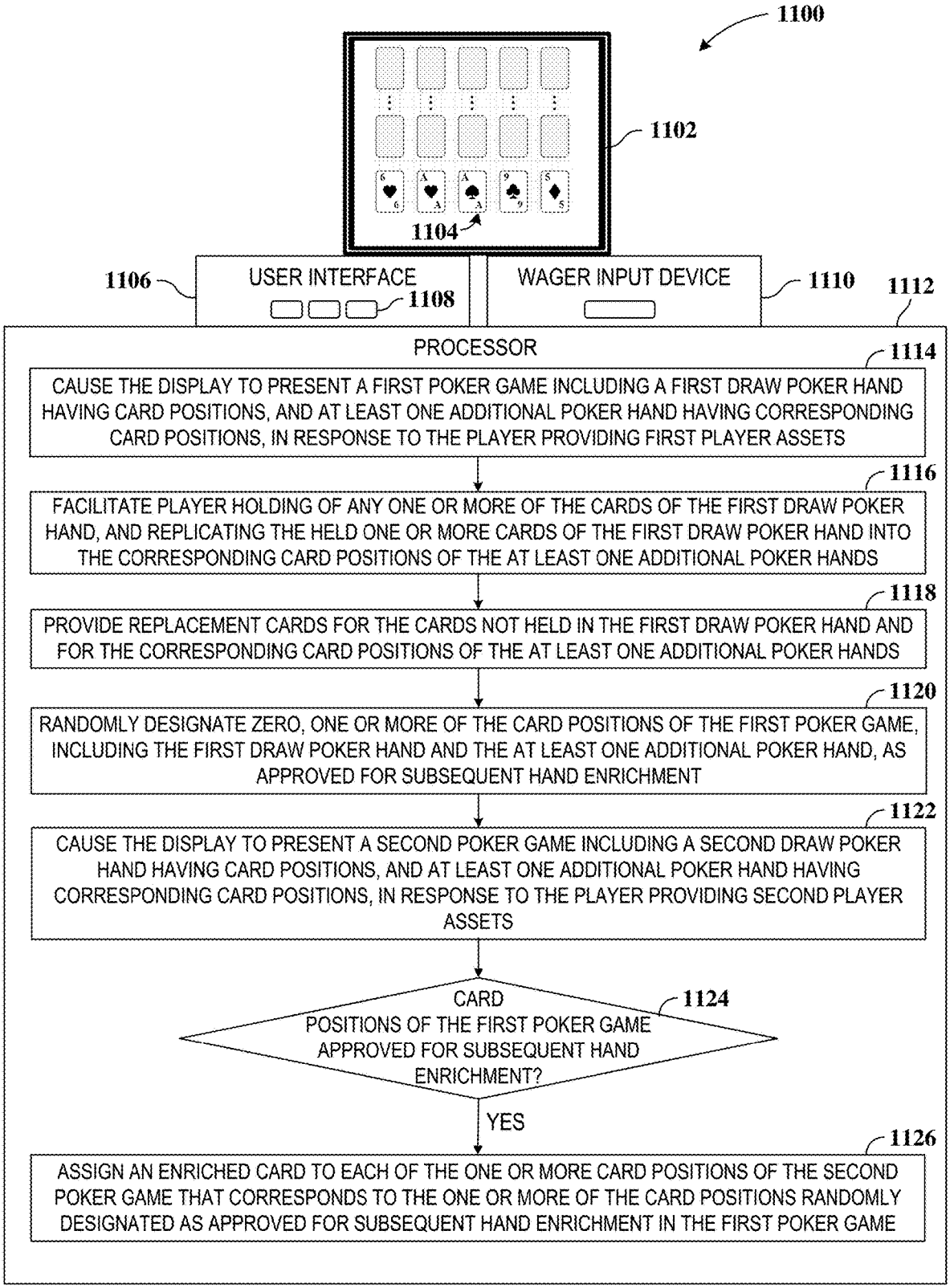

FIG. 11 is a block diagram of another representative gaming apparatus for enriching subsequent poker hands based on card position designations in prior poker hands. In the embodiment of FIG. 11, a gaming device 1100 for playing a poker game is provided. The representative gaming device 1100 includes at least a display(s) 1102 presenting a single or multiple poker hands 1104. A user interface 1106 is provided that includes at least one user input 1108 to enable a player to initiate and participate in poker hands 1104 presented via the display 1102. A wager input device 1110 may be provided, which may be structured to identify and validate player assets and ultimately permit the player to play the poker game events when the player assets are provided. For purposes of illustration, the present example is described in terms of a multi-play poker game.

In the illustrated embodiment, the processor 1112 is configured to cause 1114 the display to present a first poker game including a first draw poker hand having card positions, and at least one additional poker hand having corresponding card positions, in response to the player providing first player assets. The processor 1112 is configured to facilitate 1116 player holding of any the cards of the first draw poker hand, and replicating the held one or more cards of the first draw poker hand into the corresponding card positions of the at least one additional poker hands. Replacement cards are provided 1118 for the cards not held in the first draw poker hand and for the corresponding card positions of the at least one additional poker hands. The processor 1112 randomly designates 1120 zero, one or more of the card positions of the first poker game, including the first draw poker hand and the at least one additional poker hand, as approved for subsequent hand enrichment. The processor 1112 causes 1122 the display to present a second poker game including a second draw poker hand having card positions, and at least one additional poker hand having corresponding card positions, in response to the player providing second player assets. If one or more of the card positions of the first poker game were randomly designated as approved for subsequent hand enrichment as determined at decision block 1124, the processor 1112 assigns 1126 an enriched card to each of the one or more card positions of the second poker game that corresponds to the one or more of the card positions randomly designated as approved for subsequent hand enrichment in the first poker game. If no card positions of the first poker game were randomly designated as approved for subsequent hand enrichment as determined at decision block 1124, the second poker game is played normally without the benefit of enriched cards (not shown).

In various embodiments, the card enrichment feature may be implemented at least once on every hand, may be implemented randomly, may be implemented periodically or according to an allocation plan, may be implemented as a result of another occurrence (e.g. number of consecutive losses, consecutive wins, wager amount, etc.) and/or other established manner of providing the card enrichment feature. For example, in one embodiment, a gaming device is provided for playing an electronic/video poker game, where the gaming device includes at least a display (which may be a single or multiple presentation devices), a user interface (which may be a single or multiple player interaction devices), and a processor (which may be a single or multiple processing devices). In this embodiment, the processor is configured to cause the display to present a first hand of cards in response to player assets being allocated via the user interface to participate in the first hand of cards, and randomly designate zero, one or more of the card positions of the first hand of cards as eligible for subsequent hand enrichment. The processor is also configured to cause the display to present a second hand of cards at respective card positions in response to the player assets being allocated via the user interface to participate in the second hand of cards. If any of the card positions of the first hand of cards were randomly designated as eligible for subsequent hand enrichment, the processor is configured to assign an enriched card to each of the one or more card positions of the second hand of cards that corresponds to the one or more of the card positions randomly designated as eligible for subsequent hand enrichment in the first hand of cards.

In another embodiment, the card enrichment feature may be applied on every hand. For example, one embodiment again involves a gaming device for playing an electronic/video poker game, where the gaming device includes at least a display (which may be a single or multiple presentation devices), a user interface (which may be a single or multiple player interaction devices), and a processor (which may be a single or multiple processing devices). In this embodiment, the processor is configured to cause the display to present a first hand of cards in response to player assets being allocated via the user interface to participate in the first hand of cards, and randomly designate one or more of the card positions of the first hand of cards as eligible for subsequent hand enrichment. The processor causes the display to present a second hand of cards at respective card positions in response to the player assets being allocated via the user interface to participate in the second hand of cards, and assigns an enriched card to each of the card positions of the second hand of cards that corresponds to the one or more of the card positions randomly designated as eligible for subsequent hand enrichment in the first hand of cards.

Thus, as described herein, the disclosure herein supports poker and other gaming variants in game item positions are marked to be bettered for the player in a subsequent gaming event. The trigger may be random selection of game item positions, thereby indicating game item enrichment of some sort in connection with a future gaming event. The player could choose card locations if desired.

Players could also be afforded an opportunity to decide whether or not to keep or discard a card that has been enriched in the manners described herein. In other embodiments, enriched cards may be retained in a subsequent hand if certain rules are met, such as if that enriched card helps the player more than had the enriched card not been selected.

In other embodiments, the offering of card enrichment opportunities may be based on hand wins or hand conditions in the base game. For example, if you obtained two pair in the base game, you might be awarded one card enrichment location, if you get three-of-a-kind you might receive two card enrichment locations, if you get a straight you might get three card enrichment locations, etc.

Betting structure could be done in any desired manner. For example, the player may place a wager for a base poker game, and some additional amount to be eligible for the card enrichment features described herein. The additional amount may be a single amount to participate in all hands, or on a hand-by-hand basis, such as a particular additional wager for each hand in a multi-play poker game.

Examples include a five-credit wager for each hand in the primary poker game, plus zero additional amounts to participate in the card enrichment features (e.g., 5+0); a five-credit wager for the primary poker game, plus one additional credit for each hand played to participate in the card enrichment features (e.g., 5+1); 5+2; 5+3; 5+4; 5+5; 5+45, and so forth. For example, in a triple-play poker game (i.e. three hands concurrently played) where 5 credits are requested for each hand played and 5 additional credits for each hand to be eligible for a card enrichment trigger for subsequent hands, a total of 30 credits would be wagered (e.g., 5+5+5 for the wager for 3 primary poker hands, plus 5+5+5 to make three hands eligible for receipt of sub-symbols, highlights, or other indications for card enrichment on subsequent hands).

As previously noted, some embodiments involve identifying particular cards, or a particular subset of a resulting poker hand, or other identifying information regarding what cards are to come in a subsequent hand(s) when an earlier hand (e.g., a current hand) receives a subsequent hand enrichment notification. For example, in some embodiments, one or more cards to be made available on a subsequent hand(s) are specifically identified in the earlier hand(s), such as identifying a subset of a desirable resulting hand(s) that is made available on a subsequent hand(s) to essentially provide the player with a "head start" towards that desirable resulting hand(s). In such embodiments, the player may learn in a current hand that a subsequent hand(s) will be benefitted by starting with one or more particular cards (e.g., Ace, King, Queen, Jack of Hearts), and/or a stated subset of a resulting hand (e.g., "four-to-a-Royal-Flush"), or other information pertaining to what the actual benefit on the subsequent hand will be.

In this manner, and as an example, the player may be notified in a current hand that some preset progress or other partial progress is made towards a potential valuable winning result or any winning result, or such progress is made towards any of a plurality of potential valuable winning results or other winning results.

Figure 12:
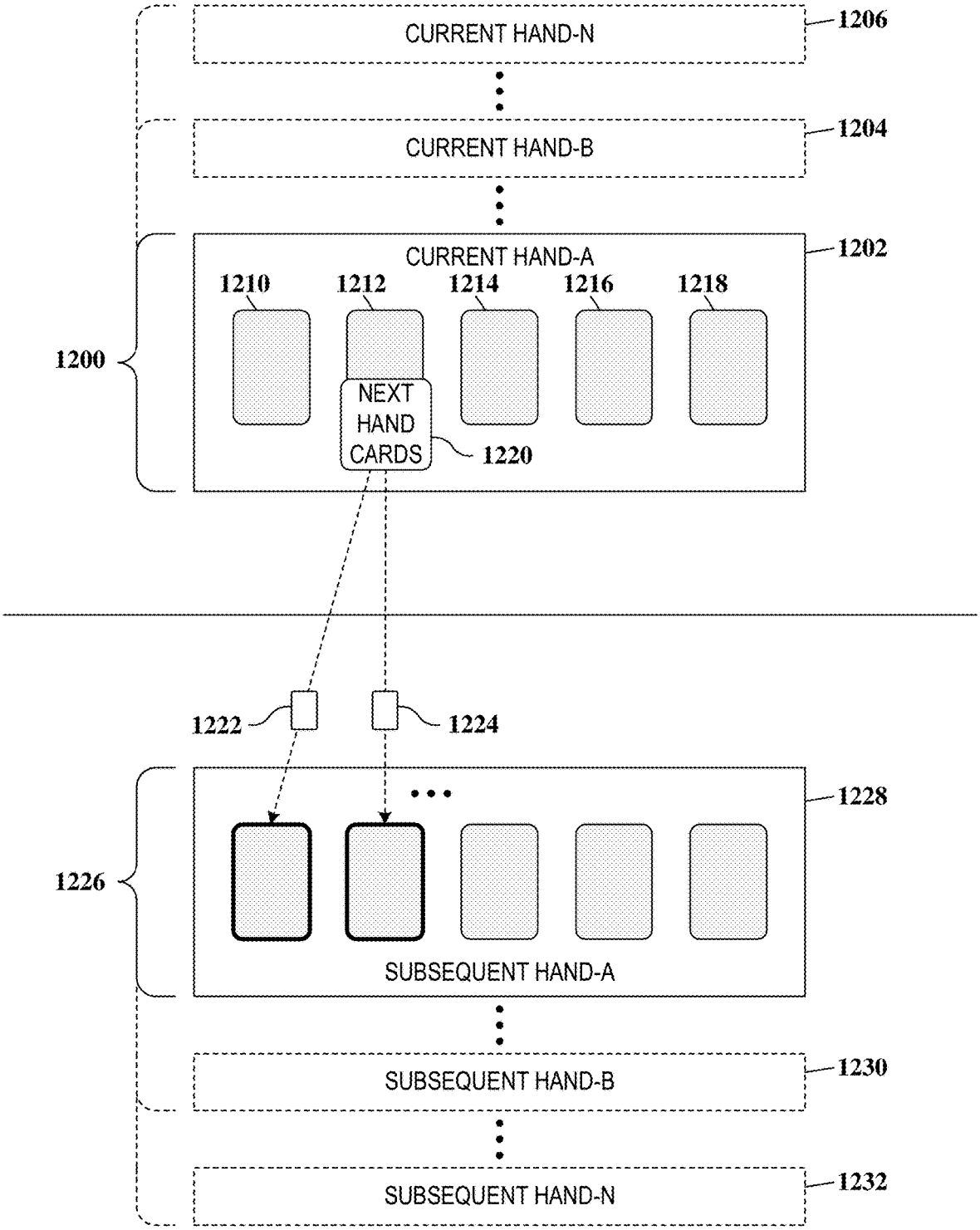
FIGS. 12 and 13 depict representative examples of a poker game that specifies, in a current poker game/hand, subsequent game/hand card enrichment particulars that may enrich or otherwise benefit that subsequent game/hand.

FIG. 12 is a block diagram of a representative example of a poker game involving consecutively-played poker games (of one or more hands per "poker deal") that specifies, in a current poker game/hand, subsequent game/hand card enrichment particulars that may enrich or otherwise benefit that subsequent game/hand.

For purposes of the description herein, references to a "current hand" or "subsequent hand" may include single hands or multiple hands (e.g. single play poker, or multi-play poker) unless otherwise noted for the particular described embodiment. Thus, a current poker game 1200 may include only one current hand-A 1202, or an additional hand such as hand-B 1204, or still one or more hands through hand-N 1206. Any additional hands may be independent hands simply played concurrently, or may be, for example, a multi-play draw poker embodiment where cards held in one hand (e.g., current hand-A 1202) are replicated into one or more other hands (e.g. hand-B 1204, hand-N 1206), or other poker variety involving more than one poker hand played at a time. For purposes of this example, activity associated with the current hand-A 1202 is described, although the description is equally applicable if one or more additional hands 1204, 1206 are also being played by the player.

In the present example, the current hand-A 1202 involves a five-card poker hand including cards 1210, 1212, 1214, 1216, and 1218, which may be at a stage of the game where they are face down, face up, some discarded, some displaced, and/or in some transition during the particular poker game being played. At some time during play of the current poker game 1200, and indication 1200 notifies the player that a subsequent hand(s) will be potentially enriched in a way that is at least partially communicated to the player.

The card information identified by the indication 1220 may be made known in the current poker game 1200 in any desired fashion, such as by way of a randomly-occurring indication, periodically-occurring indication (e.g., will occur periodically, or within every X reel spins or other gaming events, etc.), trigger-based indication (e.g., occurs when a certain card(s) is dealt or dealt to a certain position, or a particular result occurs, or the player takes a certain hold/discard risk in draw poker and wins, etc.), or other manner of providing such a potential benefit from time to time. Such indications may be provided in any desired fashion, such as a sub-symbol, symbol/grid overlay, displayed textual/graphic information, graphical representations of the cards to come, and/or any other manner of relaying the desired information.

The indication 1220 in the present example provides some indication of a subset, or in other embodiments a full set, of cards, or card groups sharing card characteristics, leading to a potentially beneficial resulting hand. In the illustrated representative embodiment, it is assumed that the indication 1220 identifies two card values or types 1222, 1224 that will be used in the subsequent hand-A 1226. An example of particular card values are specific card rank and suits, such as an Ace-Diamonds and King of Diamonds, or a Two of Clubs and a Two of Spades, etc. An example of particular card group includes suited consecutive cards (e.g., a Six of Hearts and a Seven of Hearts), X cards to a Royal Flush (e.g. any two cards of the Ten, Jack, Queen, King, and Ace of a common suit), etc. The number of cards identified by the indication 1220 may range from a single card value/type, to all cards (e.g. all five poker cards), depending on factors for the particular poker game.

Thus, card groups sharing at least one common characteristic may not specifically identify every card, but provides enough information to inform the player of a potential benefit. For example, a card group sharing at least one common characteristic may be four cards towards a Royal Flush, where at least two common characteristics are beneficial in that the card group includes four of the five card ranks creating a Royal Flush (e.g. four cards among the Ten, Jack, Queen, King and Ace) and are of a common suit. Thus any four of the five cards, in any common suit, will form four cards towards a Royal Flush, so in such instance specific cards (i.e. specific card rank and card suit) need not be provided, although in other embodiments those specific card ranks/suits may indeed be provided. As another example, "3-to-Quads," which already represents Three-of-a-Kind, only need be the same card rank, but may not matter what the particular card rank is (e.g., could be Three-of-a-Kind in Fives, Three-of-a-Kind in Jacks, etc.). Thus, references to card groups or card types herein may still provide a perceivable benefit to the player, as sufficient information about those card groups enables the player to understand a potential benefit, even without knowing the specific card rank and/or suit for every card provided via the subsequent hand enrichment feature.

In one embodiment, the subsequent poker game 1226 is reached when the player allocates additional player assets to participate in it. In one embodiment, the player could therefore leave the poker apparatus after receiving the next hand cards 1220 indication and not receive the benefit, as the subsequent hand 1228 was not paid for and played. In one embodiment, another player could receive such subsequent hand benefit by playing the gaming apparatus where such subsequent poker game 1228 had received the indication 1220 from a prior poker game 1202.

The subsequent poker game 1226 may include only one hand-A 1228, or an additional hand such as hand-B 1230, or still one or more hands through hand-N 1232. Any additional hands may be independent hands simply played concurrently, or may be, for example, a multi-play draw poker embodiment where cards held in one hand (e.g., subsequent hand-A 1228) are replicated into one or more other hands (e.g. hand-B 1230, hand-N 1232), or other poker variety involving more than one poker hand played at a time. In some embodiments, the provided cards 1222, 1224 may go to specific card positions at subsequent hand-A 1228, or made go to random positions or other positions of the hand-A 1228 (and/or other hands 1230, 1232 in other embodiments). In this example, subsequent hand-A 1228 will be allowed to begin with the cards identified by the indication 1220 from a previously-played hand 1202 (or another hand of a multiple-hand poker game in other embodiments), thereby giving the player immediate progress towards one or more resulting hands that may be of high value.

The "subsequent" poker game 1226 may represent the immediately succeeding poker game relative to the poker game 1200 in which the indication 1220 occurred, or may be a future game that does not immediately succeed the poker game 1200 in which the indication 1220 occurred. In one embodiment, game rules will determine which poker game following the current poker game 1200 will receive the benefit of the enriched cards. In another embodiment the indication 1220 or other communication may notify the player which future hand will receive the benefit of the enriched cards. In still another embodiment, triggering events in the subsequent poker games may dictate when the cards identified by the indication 1220 will be used (e.g., receiving particular cards during play, or a randomly-provided sub-symbol or other indication in the subsequent game, etc.). These are merely examples, and the particular subsequent hand in which the benefit is received may vary depending on the particular application.

In one embodiment, the indicator 1220 and/or any other indication identifying the subset of cards or card groups may be used to provide card enrichment with one or more hands 1202, 1204, 1206 of the current poker game 1200. Enriching cards in a hand(s) of the current poker game 1200 may be done in lieu of enriching cards in a hand(s) of a subsequent poker game(s) 1226, or may be done in addition to enriching cards in a hand(s) of a subsequent poker game(s) 1226.

For example, at any time during play of a current multi-play poker game 1200, one or more identifiers 1220 (or other manner of identifying the card enhancement benefit) may be provided to designate a subset of cards or card group for card enrichment, or at least potential card enrichment, on one or more currently played poker hands 1202, 1204, 1206. The indicator may identify the hand for card enrichment for the current poker game 1200. For example, if the indicator 1220 occurs on hand 1202, then hand 1202 may receive the benefit, or alternatively the next concurrently-played hand 1204 may receive the benefit, etc. Thus, if the indicator 1220 of hand 1202 identified a card subset of 4-to-a-Royal-Flush, then in one embodiment hand 1202 would begin with (or replace already-dealt cards to begin with) four cards of a Royal Flush, which may occur instead of, or in addition to. a subsequent poker game 1226 obtaining the benefit.

In one example, the indicator 1220 and/or any other indication identifying the cards/card group enhancement may be used to provide card enrichment with both the current poker game 1220 and the subsequent poker game(s) 1226. In a more particular example, at any time during play of a current multi-play poker game 1200, one or more indications (e.g. indication 1220) indicating some subset of cards or card types may be provided to give a beneficial head start to one or more currently played poker hands 1202, 1204, 1206 of the current poker game 1200, which will then also carry over to a subsequent poker game(s) 1226, such as one or more subsequently played poker hands 1228, 1230, 1232. In such an embodiment, the hand 1228, 1230, 1232 of the subsequent poker game 1226 may correspond to the hand 1202, 1204, 1206 of the current poker game 1200 where the indicator 1220 occurred (e.g. if in the first hand 1202 of current poker game 1200, then the benefit is provided to the first hand 1228 of the subsequent poker game 1226), or the subsequent hand 1228, 1230, 1232 may be randomly selected, cycled through on each occurrence of an indication 1220, fixed on a particular one or more of the hands 1228, 1230, 1232, or however else desired. In some embodiments, the subset of cards and/or card types made available to the subsequent poker game 1226 may be different from the subset of cards and/or card types identified and used in the current poker game 1200, where in other embodiments the subset of cards and/or card types made available to the subsequent poker game 1226 are the same as the subset of cards and/or card types identified and used in the current poker game 1200.

Thus, descriptions herein relating to benefitting a subsequent hand(s) are also applicable to embodiments where the poker game/hand in which the benefit originates (e.g. where the indication 1220 or other indication occurs) obtains the benefit of the enriched card(s) in addition to the subsequent hand(s) that receive the benefit. Additionally, descriptions herein relating to benefitting a subsequent hand(s) are also applicable to embodiments where the poker game/hand in which the benefit originates (e.g. where the indication 1220 or other indication occurs) obtains the benefit of the enriched card(s) instead of the subsequent hand(s) receiving the benefit.

Figure 13:
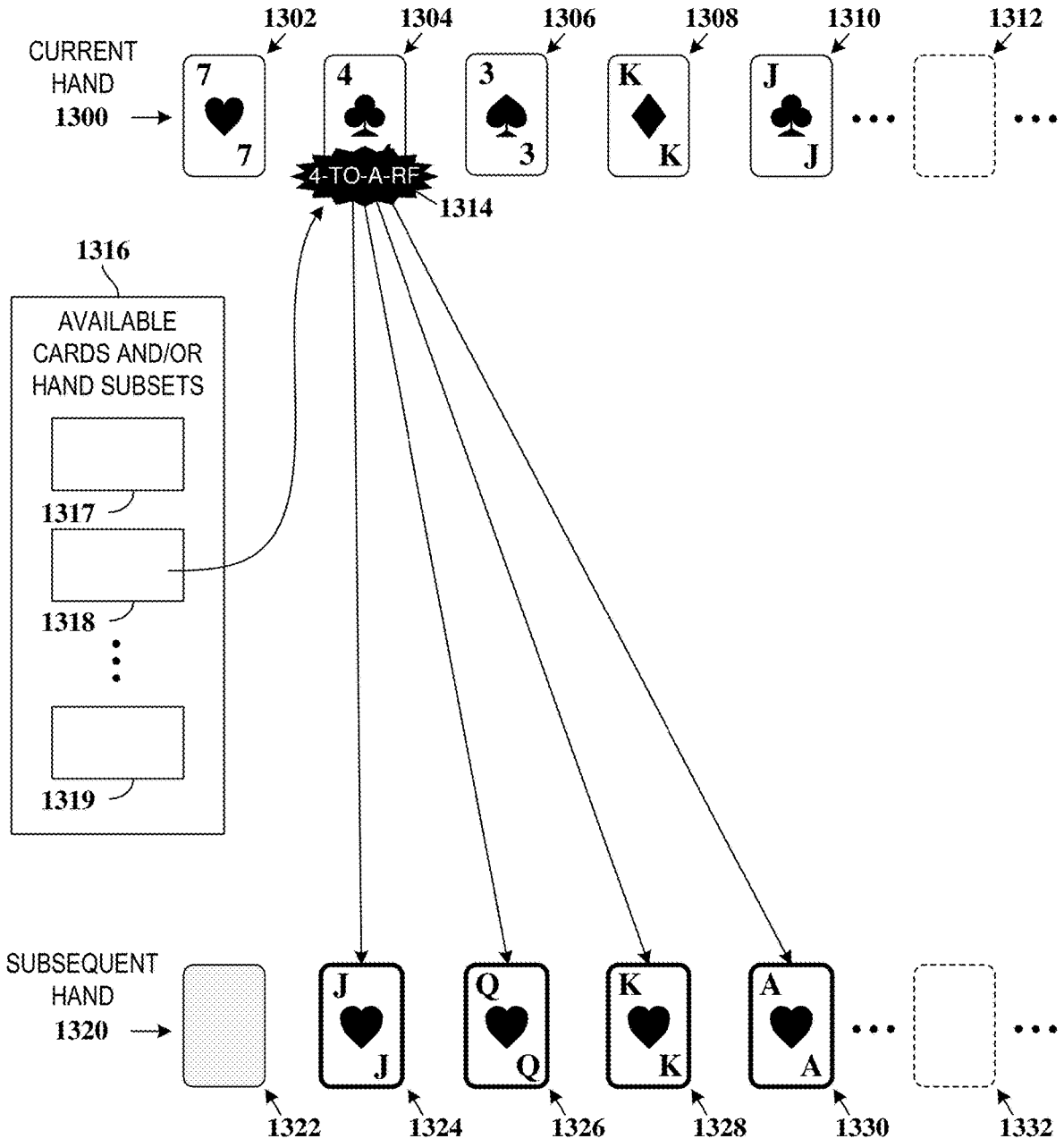

FIG. 13 provides a more particular, representative example of a poker game that identifies subsequent game/hand card enrichment particulars that may enrich or otherwise benefit that subsequent game/hand. The example of FIG. 13 involves a single current hand 1300, although the principles described are equally applicable to multiple-hand games, and different types of poker games including but not limited to stud poker, draw poker, and any other poker variants.

A first hand 1300 may represent any dealt poker hand, such as a hand in stud poker, an initial hand in draw poker, etc. In the present example, a sub-symbol(s) 1314 identifies the awarding of a subsequent hand enrichment, although any manner of identifying cards for use in a subsequent hand(s) may be employed. In this example, a hand of five cards is dealt, namely cards 1302, 1304, 1306, 1308, 1310. In card games where there are fewer than five cards, then one or more of the cards 1302, 1304, 1306, 1308, 1310 would not be dealt. In games where there are more than five cards, then one or more additional cards 1312 may be dealt. In the present example, the poker game involves an initial deal of five cards 1302, 1304, 1306, 1308, 1310, respectively depicted as the 7-Hearts, 4-Clubs, 3-Spades, King-Diamonds, and Jack-Clubs.

In the illustrated embodiment, an indicator 1314, depicted as a sub-symbol, overlay, and/or other perceivable designation, is randomly awarded to notify the player of subsequent hand enrichment. In some embodiments, more than one such awarded indicator 1314 may be provided, with the associated cards being dealt to different hands in subsequent hands, whether different hands in a multi-hand play, different hands on further successive poker games, or the like. In other embodiments where multiple indicators 1314 may be presented, rules may be provided to select one of them, such as randomly selecting one of the multiple indicators 1314 for use, using the one of the multiple indicators 1314 that provides the greatest benefit, or alternatively the lesser benefit, or other designated rules. The indicator(s) 1314 may appear before the initial deal, in connection with the initial deal, in connection with discarding cards, in connection with obtaining replacement cards, etc.

In the illustrated embodiment, single indicator 1314 notifies the player of what will be provided to a subsequent hand(s) 1320. In one embodiment, there may be only one card or group of cards that is available to be used in the subsequent hand the $13^{th}$ 20. For example, in one embodiment, if the indicator 1314 is presented, the cards provided on the subsequent hand 1320 may always be the same potential benefit, such as four cards towards a Royal Flush (depicted as "4-TO-A-RF" in this example). In other embodiments, there may be a plurality of such available cards or sets of cards, such as depicted by the pool 1316 of available cards and/or hand subsets 1317, 1318, 1319. In the illustrated example, the hand subset 1318 was selected, such as randomly selected from the pool 1316, which in the example corresponds to the 4-TO-A-RF identified via the indication 1314. Had a different hand subset from the pool 1316 been selected, such as hand subset 1317, a different result may have occurred, such as the indicator 1314 noting the subsequent hand enrichment to be three Aces (for example). Individual ones of the available cards and/or hand subsets from the pool 1316 may be selected in any desired manner, such as randomly selecting from the pool 1316, systematically cycling through each of the available ones of the available cards and/or hand subsets from the pool 1316, providing weights of statistical selection probability to each of the cards and/or hand subsets of the pool 1316, etc.

Further, each of the cards and/or hand subsets 1318, 1318 through 1319 of the pool 1316 of available cards and/or hand subsets may include a single card, multiple cards forming a subset of a subsequent hand 1320, or all of the cards needed to form a resulting subsequent hand 1320. Single card examples include a Wild card (serves as any card), or a Wild card with Multiplier (serves as any card and additionally provides a multiplier to further increase a payout in the subsequent hand 1320, a high value card (e.g. a Two of any suit where Twos provide the highest payout for Four-of-a Kind), etc. Multiple card examples include, for example, Three-of-a-Kind (hopefully leading to a Four-of-a-Kind, or Full House), X cards (e.g. four cards) toward a Royal Flush, or other subset of a potentially high value resulting hand, etc. In some embodiments, all cards may be provided, such as where one of the subsets 1322 of the pool 1316 actually represents the entire set, such as Four-of-a-Kind, a Royal Flush, etc. In some embodiments, combinations of available cards and/or hand subsets 1316 may be provided, such as a group of cards to begin a potentially good hand (e.g. 4-to-a-Royal Flush) and a multiplier or wild card with multiplier.

In this manner, the card subset 1318 to be awarded, selected from the pool 1316 in this example, and made known to the player via the indication 1314, is provided to the subsequently dealt hand 1320 (e.g. the hand immediately subsequent to played hand 1300 in one example). Since the indication 1314 in this example noted that the player would receive four cards towards a Royal Flush, those four cards are provided as four of the five cards of the subsequent hand 1320, depicted now in the subsequent hand 1320 as cards 1324, 1326, 1328, 1330 (although the cards may be positioned in any order and any of the cards for that poker game). Therefore, in a five-card poker game, only one card 1322 remains to be dealt to the player, who would hope to obtain a Ten-Hearts in this example to obtain a Royal Flush.

In one embodiment, the subsequent hand 1320 may be a five-card, stud poker game where what is dealt as card 1322 provides the resulting hand. In another embodiment, the subsequent hand 1320 may be a stud poker game involving more cards than five (e.g. including one or more cards 1332), where the player uses the best five cards such that the opportunity to obtain the Royal Flush is greater since cards 1322 and 1332 will be provided.

Figure 14A:
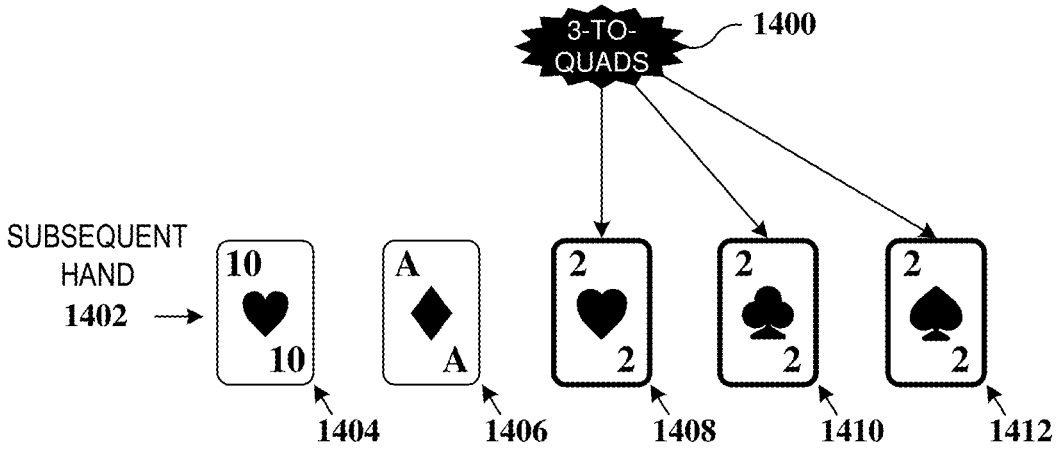
FIGS. 14A and 14B depict embodiments respectively involving stud poker and draw poker games that received a poker hand subset from a prior hand.

FIG. 14A depicts an embodiment involving such a five-card stud poker game that received a poker hand subset as a result of a prior hand. The indicator 1400 depicts an indication from a prior hand that the player was awarded with a subsequent hand 1402 enrichment. The indicator indicates, in this example, "3-to-Quads," meaning Three-of-a-Kind and consequently three cards towards a Four-of-a-Kind. In this example, the indicator 1400 provides an indication of a card group versus specific cards, in that it does not identify the specific poker cards that constitute the "3-to-Quads." In one embodiment, the particular card values may be randomly selected, selected by the player, selected based on other gaming activity (e.g., other dealt cards, wager amount, etc.), or the like. In this example, the "3-to-Quads" is provided to the subsequent hand 1402 as three Twos, namely the 2-Hearts, 2-Clubs, and 2-Spades, although other embodiments may have provided the three like cards in a different poker value and/or suits. In this stud poker example, the remaining dealt card 1404 (Ten-Hearts) and 1406 (Ace-Diamonds) form the rest of the stud poker hand, resulting in the player obtaining a Three-of-a-Kind in Twos, but failing to reach the potential goal of Four-of-a-Kind (Quads).

Returning briefly to FIG. 13, the subsequent hand 1320 may be a draw poker variant in other embodiments. In such case, one embodiment involves disallowing standard hold/replace of the cards 1322 that are not provided by way of the enriched cards 1324-1330. In other words, in such an embodiment, the player may be dealt a card 1322 to fill out the five card poker game, and not be allowed to discard/replace the card 1322 even if the game is normally a draw poker game. In another embodiment, the player is still allowed to discard/replace the card 1322 notwithstanding receiving the cards 1324-1330. These or other rules may be applied to games involving the subsequent hand enrichment features described herein.

Figure 14B:
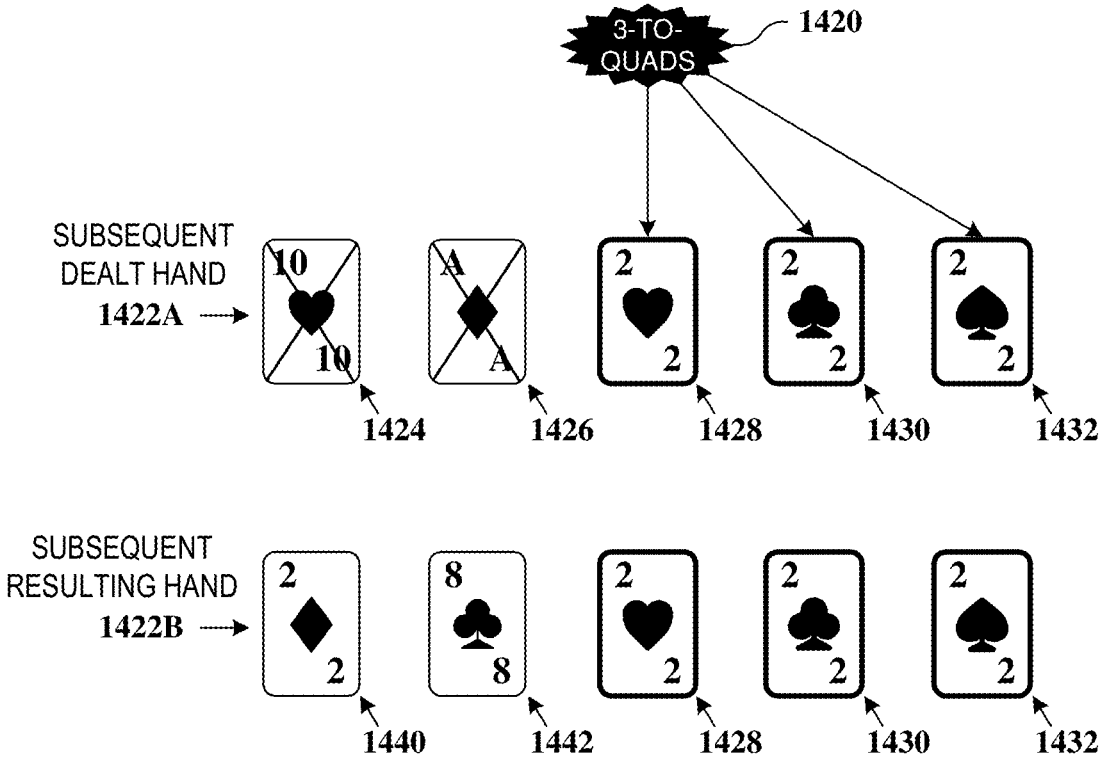

FIG. 14B depicts an embodiment involving a five-card draw poker game that received a poker hand subset as a result of a prior hand. The indicator 1420 depicts an indication from a prior hand that the player was awarded with a subsequent hand enrichment. The representative indicator in this example again indicates "3-to-Quads," meaning Three-of-a-Kind and consequently three cards towards a Four-of-a-Kind. As in the case of FIG. 14A, the indication 1420 could have instead provided specific card values such as, for example, King-Hearts, King-Spades, and King-Diamonds to provide three cards towards a Four-of-a-Kind, but in such an example the specific cards would be presented rather than a less specific card group of cards sharing some characteristics (e.g. subset of a winning hand, like poker rank, like poker suit, like poker rank and poker suit, etc.).

In this draw poker example, the enriched cards, three Twos in this example, are provided as shown by cards 1428, 1430 and 1430 of subsequent dealt hand 1422A. Assuming an embodiment where the player is still allowed to discard one or more cards to obtain replacement cards in the draw poker variant, this example shows the player holding the cards 1428, 1430, 1432, and discarding cards 1424, 1426. The subsequent resulting hand 1422B depicts the state of the hand after new cards are provided for those that were discarded. Specifically, the three Twos 1428, 1430, 1432 were held and remain in the subsequent resulting hand 1422B, but new cards 1440 (Two-Diamonds) and 1442 (Eight-Clubs) replace the cards 1424, 1426 that were discarded from the dealt hand 1422A. In this example, card 1440 is the Two-Diamonds, thereby providing Four-of-a-Kind (four Twos) for the subsequent resulting hand 1422B.

Figure 15:
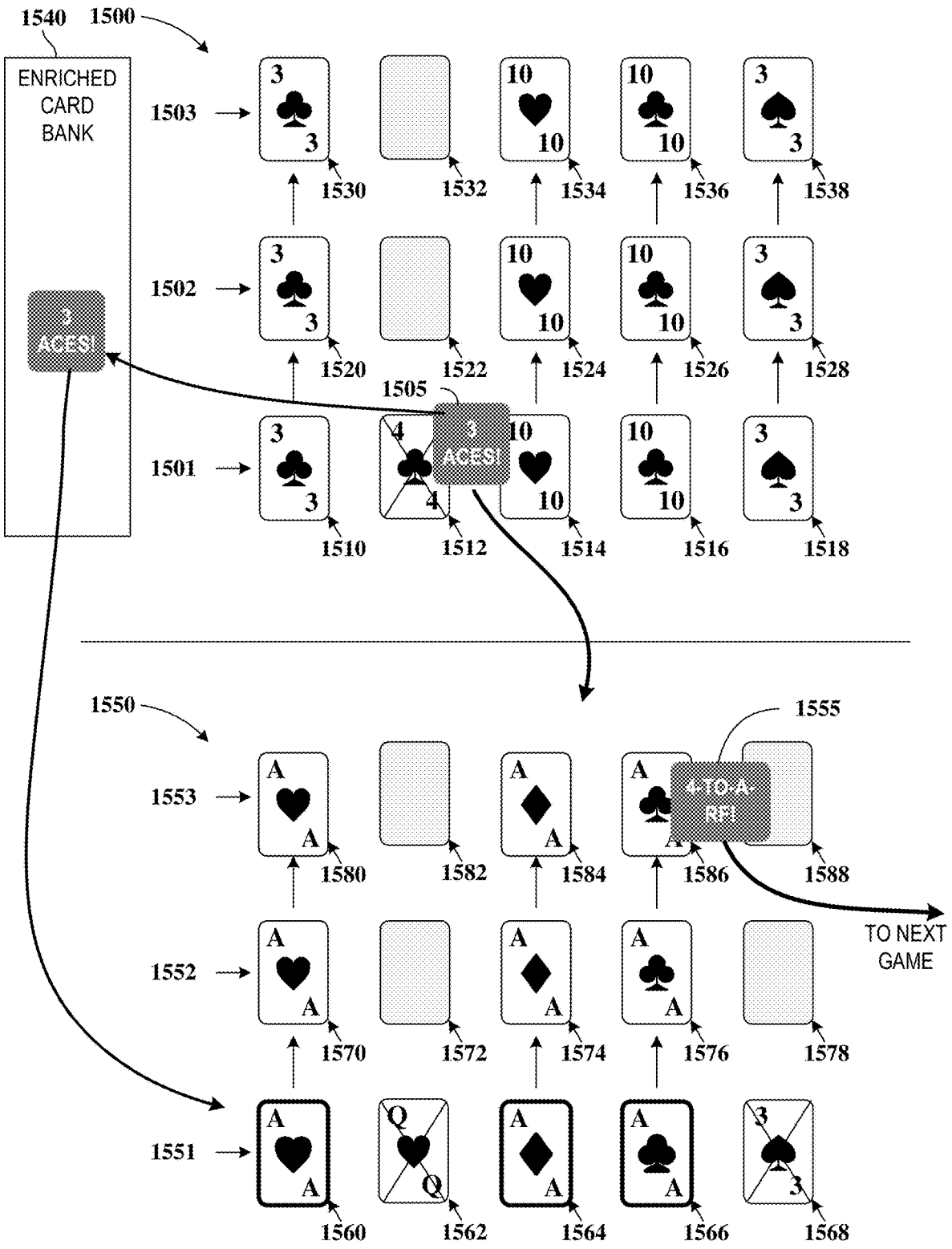
FIG. 15 depicts a multi-play poker game involving multiple concurrently-played hands, where an award notice may be provided in connection with a multi-play poker game for use in one or more hands of a subsequent multi-play poker game.

FIG. 15 is described in the context of an electronic, multi-play, poker game embodiment. FIG. 15 depicts a current poker game 1500 involving three concurrently-played hands 1501, 1502, and 1503, played in a multi-play fashion where cards held in one hand (e.g. hand 1501) are replicated into (at least one of) the other hands (e.g. hands 1502, 1503).

The first hand 1501 is dealt, which in the illustrated embodiment includes card 1510 (3-Clubs), 1512 (4-Clubs), 1514 (10-Hearts), 1516 (10-Clubs) and 1518 (3-Spades). In accordance with one embodiment, at any time during play of the current poker game 1500, an indication(s) 1505 may be provided to specify some cards and/or poker hand subset for card enrichment, or at least potential card enrichment, on one or more subsequently played poker hands, such as in connection with the subsequent poker game 1550. For example, in connection with dealing the first hand 1501 (whether before or after the card indicia is presented to the player), some indication 1505, such as the depicted visual overlay, may be presented in any fashion in connection with the current poker game 1500.

This indication 1505 identifies that the player has received a subsequent poker game 1550 benefit, and provides some indication as to what that benefit will be. In one embodiment, the indication as to what the benefit will be presented on the indication 1505 itself, while in other embodiments such information may be presented in any other fashion in any manner desired. In one embodiment, this indication 1505 is provided randomly in connection with normal participation in the current poker game 1500.

The current hands 1501, 1502, 1503 may then be played out to their conclusions to provide respective resulting hands. In this example, 1510, 1514, 1516, and 1518 are replicated into the other concurrently-played hands 1502, 1503, as seen by card 1510 being replicated into cards 1520 and 1530 of hands 1502 and 1503 respectively; card 1514 being replicated into cards 1524 and 1534 of hands 1502 and 1503 respectively; card 1516 being replicated into cards 1526 and 1536 of hands 1502 and 1503 respectively; and card 1518 being replicated into cards 1528 and 1538 of hands 1502 and 1503 respectively. Card 1512 was discarded, and therefore replacement cards will be provided in place of card 1512 of hand 1501 and the corresponding cards 1522 and 1532 of hands 1502 and 1503 respectively.

Poker game 1550 represents a subsequently-played poker game, such as the immediately succeeding poker game relative to poker game 1500. As noted by the indication 1505 of poker game 1500, three Aces are provided to the poker game 1550. In one embodiment, these three Aces are provided to the first hand 1551 of the multi-play poker game 1550 also including hands 1552 and 1553, as seen by cards 1560, 1564, and 1566. The remaining cards 1562 and 1568 are dealt to hand 1551, of which the player may hold or discard in this embodiment. In the example of FIG. 15, the player has elected to discard both the cards 1562, 1568, and hold the three Aces that were provided by way of the prior hand 1500 being awarded the subsequent hand benefit specified by indication 1505. Therefore, cards 1560, 1564, and 1566 of hand 1551 are respectively replicated into cards 1570, 1574 and 1576 of hand 1552, and cards 1580, 1584, and 1586 of hand 1553. When replacement cards are provided in place of card 1562 and 1568 of hand 1551, in place of card 1572 and 1578 of hand 1552, and card 1582 and 1588 of hand 1553, final resulting hands will be provided, all with the replicated three Aces, and any of the hands potentially drawing a fourth Ace to provide Four-of-a-Kind in Aces.

In one embodiment, the benefit identified via the indication 1505 is instead or additionally stored in a visible bank or repository, such as in a special place on the video poker machine outside of the game play area. The player is then reminded that this obtained benefit (e.g. the set of cards or card groups) is available on a subsequent hand. Such a visible enriched card bank 1540 is depicted in FIG. 15, where it is stored in connection with the current poker game 1500, and made available in the subsequent poker game 1550.

The subsequent hand benefit feature may be provided on any of the hands, whether systematically provided on each hand, or provided periodically, or provided based on a trigger, or provided entirely randomly, or the like. In the illustrated embodiment, another indication 1555 is provided in connection with poker game 1550 that will be used in yet another subsequent poker game (not shown). In this example, a "4-to-a-RF" (four cards of a Royal Flush) is noted via indication 1555, such that at least one hand of the next poker game will be benefited with a four card head start towards obtaining a Royal Flush.

In one embodiment, the indication 1505, 1555 may be provided in connection with one of the multiple poker hands, and then utilized on a corresponding one of the poker hands on the subsequent hand(s). For example, in such an embodiment, had the indication 1505 occurred in connection with a card(s) of a certain hand of the current poker game 1500, such as hand 1502, then in one embodiment the 3 Aces would be provided to hand 1552 of the subsequent hand 1550. In such an embodiment, rules may be implemented to address this in a multi-play context where cards held in hand 1551 are able to be replicated into other hands 1552, 1553, such as allowing the player a choice to override the 3 Aces (or other cards identified by the indicator 1505) with replication, or to allow hand 1552 and subsequent hand 1553 to obtain the benefit of the cards identified by the indication 1505, while having other hands (e.g. 1551) operate independently. In still other embodiments where multiple poker hands are played concurrently but there is no "multi-play" replication of held cards, then the association of the indication 1505 with a particular one of the hands 1501, 1502, 1503 (and more if more hands are available) can cause the corresponding one of the hands 1551, 1552, 1553 of the subsequent poker game 1550 to receive the benefit independently of the remaining hands of that poker game.

In one embodiment, the indication 1505 and/or other indication may provide an indication of multiple card enhancements, such as the "3 Aces" (or other winning hand subset) and a multiplier, or a winning hand subset and a wild card, or a winning hand subset and a wildcard with multiplier, etc. Thus, either by way of a single indication 1505, or by way of multiple indications, the benefit provided to the subsequent poker game(s)/hand(s) may include more than one distinct type of benefit.

As previously noted, the indication used to reflect the game's provision of a reward, and the information pertaining to what the subsequent hand benefit will be, may be provided in any desired manner. FIGS. 16A 16G depict representative examples of providing indications of the award of an enrichment or benefit to a subsequent poker hand or other gaming event, which are presented for purposes of illustration and understanding, and does not represent an exhaustive list.

FIG. 16A depicts a poker hand 1600. Whether before the initial deal of the cards of the hand 1600, during the initial deal, after the initial deal, before/during/after selecting cards to discard and/or obtaining replacement cards in a draw poker environment, or any other time associated with play of the poker hand 1600, an indication 1602 may be provided on the play screen or elsewhere. In the embodiment of FIG. 16A, the indication 1602 represents an actual depiction of the specific cards that will be provided to the subsequent poker hand.

FIG. 16B depicts another example (shown in a multi-play poker context but equally applicable to poker embodiments of any number of hands) where a banner, textual block, graphic image, overlay, sub-symbol, and/or other item is visually presented via the indication to notify the player that a particular subsequent hand award has been granted. For example, the textual banner 1612 identifies that the player will receive, on a subsequent hand, four cards of a Royal Flush ("4-TO-A-ROYAL FLUSH). In another example, the symbol/card overlay 1614 may present such information. The textual banner 1612 and the card overlay 1614 are merely examples of manners in which textual and/or graphic information may relay the subsequent hand benefit to the player.

FIG. 16C depicts another example in which textual and/or graphic indicator 1620 may be presented to the player, outside of the play area 1622, on a display screen 1624 or other presentation medium on which the play area 1622 is presented, or on another display screen or presentation medium (not shown). The occurrence of, highlighting of, and/or other visual, audio and/or tactile presentation of the textual and/or graphic indicator 1620 may make the player aware of the award of a subsequent hand benefit, and may further identify what that subsequent hand card enrichment or other benefit will be. For example, the indicator 1620 may change from a first state to a second state indicating "4-TO-A-ROYAL FLUSH," thereby both providing the award notice as well as what the award will entail. This displayed indicator 1620 may show the award in a textual manner, graphics, card representations (e.g., such as indicator 1602 of FIG. 16A), or other perceivable notice of the occurrence of and value associated with the subsequent hand benefit.

FIG. 16D depicts use of a sub-symbol 1630 provided in connection with play of a poker hand(s) 1632. In one embodiment, such sub-symbol 1630 is randomly presented in a manner to be visually perceived in connection with play of the poker hand 1632, such as on or near one or more of the cards of the poker hand 1632. The sub-symbol 1630 may directly identify the subsequent hand benefit to the player, or in other embodiments the information may be coded on the sub-symbol 1630. For example, a table or other manner of correlating information, such as correlation table 1634 may be provided with sub-symbol 1630 codes 1636 and corresponding subsequent hand player benefits 1638. Thus, in an embodiment utilizing colors as the code 1636 on the sub-symbol 1630, an example may be that a red sub-symbol 1630, or alternatively/additionally marked with a code "R" for "red" may correspond to providing four cards to a Royal Flush ("4-TO-A-RF") to a subsequent poker hand. One or more such sub-symbol "code-to-benefit" correlations may be provided.

FIG. 16E depicts an embodiment where conditions associated with play of the current poker game may trigger providing the indication of the subsequent hand benefit award, and/or the value of the subsequent hand benefit itself. The player may be notified of such trigger conditions and corresponding subsequent hand benefits in any manner, such as a visual table 1640 providing correspondence between the poker game trigger conditions 1642 and the subsequent hand benefits 1644. For example, particular presented cards in the current poker game, patterns of activity, and other game-related triggering conditions may be made to correspond with awarding particular subsequent hand benefits. In one example, the poker game trigger condition 1642 may be a series of consecutive winless poker hands, and when such triggering losing streak occurs, an award is notified to the player, with an indication of what that subsequent hand benefit 1644 will be (e.g. "4-TO-A-RF"). One or more such "trigger-to-benefit" correlations may be provided.

In still other embodiments, cards from the currently-played hand may be used as the beneficial cards in the subsequently-played hand. For example, cards from an initial deal or a resulting hand may be randomly (or otherwise) awarded as the enriched cards in a subsequent hand(s). This may be triggered randomly, as noted. In other representative embodiments, this may be triggered based on the actual cards that arose in the currently-played poker game/hand(s), and in certain embodiments some, but not all, card combinations may cause the trigger to enable those cards to be used in the subsequent hand.

Figure 16F:
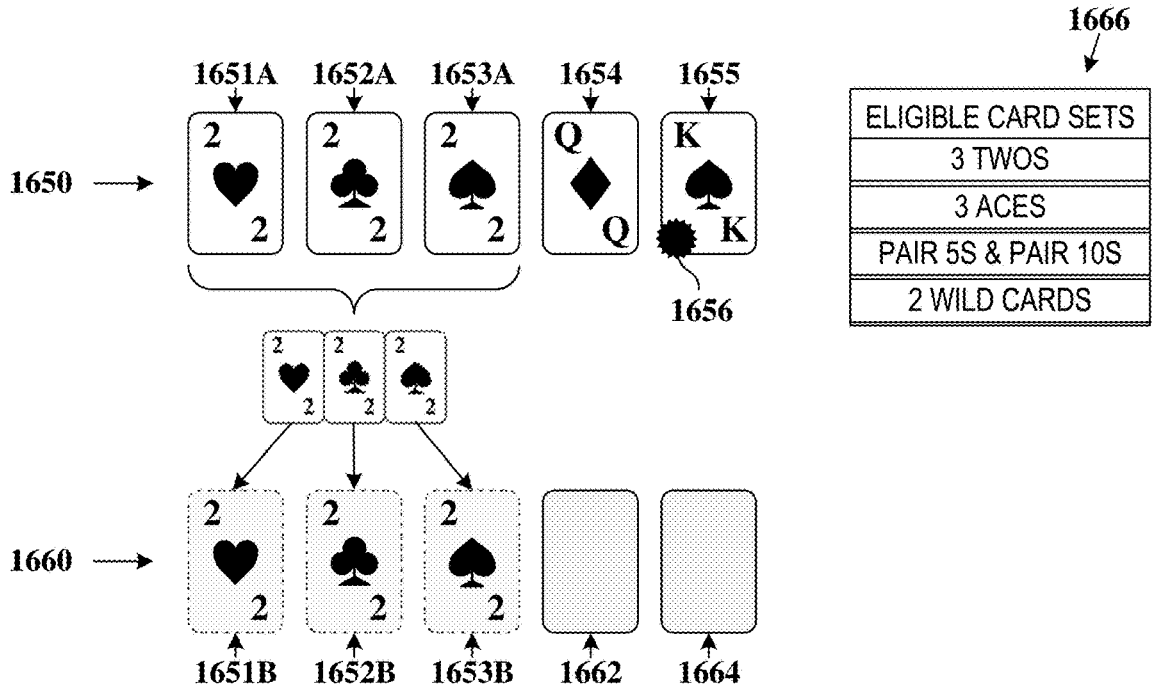
Figure 16G:
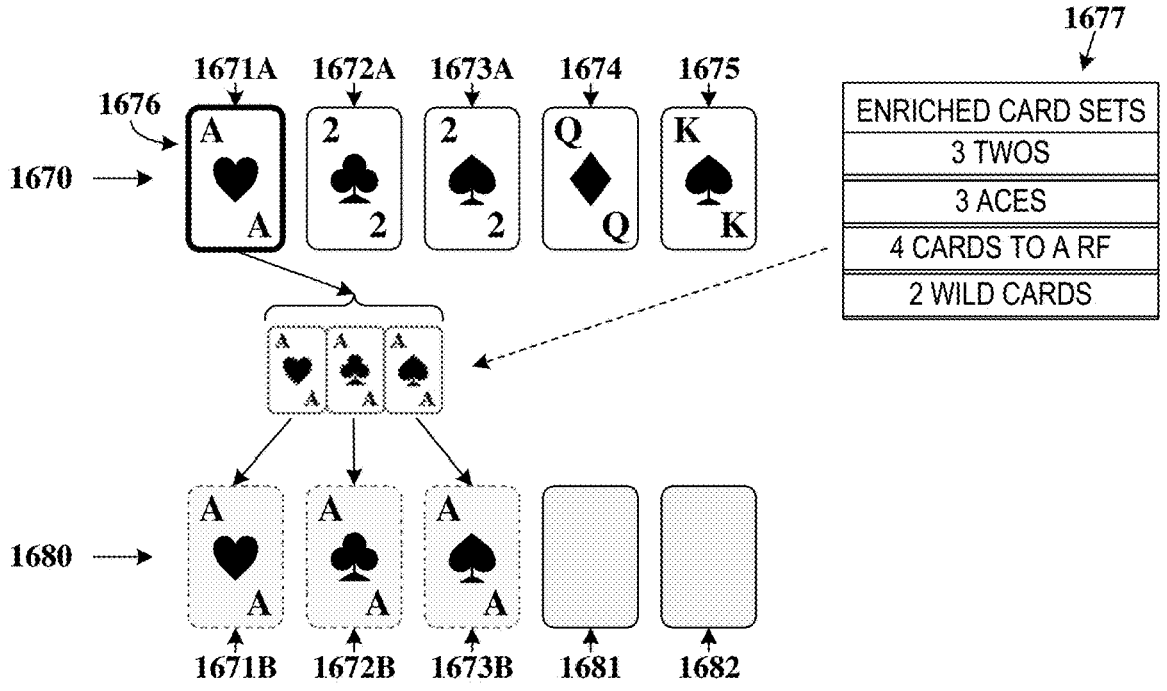

For example, FIG. 16F depicts an embodiment where resulting cards from a current hand 1650 are provided to a subsequent hand(s) 1660. The trigger may be particular cards occurring in the current hand 1650, occurrence of a sub-symbol or other signal when a particular card or subset of cards occurs, or the like. For example, in one embodiment, a resulting current poker hand 1650 includes five cards, 1651A, 1652A, 1653A, 1654 and 1655, where Three-of-a-Kind in Twos occurs with cards 1651A, 1652A, and 1653A. In this embodiment, because of the concomitant occurrence of the sub-symbol 1656, the current hand 1650 subset of Three-of-a-Kind (or alternatively three cards towards a Four-of-a-Kind) is awarded as a subsequent hand benefit for the subsequent hand 1660, as noted by cards 1651B, 1652B and 1653B. The subsequent hand 1660 will therefore begin with Three-of-a-Kind, with the player's hopes of improving to a Four-of-a-Kind or Full House, when the subsequent hand 1660 is completed with the remaining cards 1662, 1664.

In another embodiment, particular cards or card groups may themselves trigger the use of those same cards in the subsequent hand 1660. For example, some predetermined card groups may be eligible for the subsequent hand benefit, and such predetermined card groups may be made known to the player in any desired fashion, including a table 1666 or other presentation. The table 1666 may identify those cards and/or card groups that are eligible for the subsequent hand benefit. As examples only, the table 1666 identifies 3 Twos, 3 Aces, a Pair of 5s together with a Pair of 10s, and 2 Wild cards as eligible for use in the subsequent hand 1660. In such an example, if 3 Twos occur for cards 1651A, 1652A, 1653A, those cards will be used in the subsequent hand 1660 as seen by cards 1651B, 1652B, and 1653B of subsequent hand 1660. The 3 Twos may be provided in any position of the subsequent hand 1660. Using these cards, the subsequent hand 1660 poker game may then be carried out, in a stud poker fashion, draw poker fashion, or other poker variety. Thus, in embodiments in the vein of the example of FIG. 16F, particular cards or card groups in one hand 1650 may trigger their use in a subsequent hand 1660.

In yet other embodiments, a particular card or occurrence at a particular card position, or particular cards or occurrences at particular card positions, can trigger a different card or card group to be provided to a subsequent hand for its benefit. FIG. 16G depicts an embodiment where the occurrence of a particular card (or one of a plurality of particular cards) is presented at a particular card location (or at least one of a plurality of particular card locations). A current hand includes cards 1671A, 1672A, 1673A, 1674 and 1675. In this example, it is assumed that occurrence of an Ace at a particular card position, the first card position 1676 in this example, will trigger a subsequent hand 1680 benefit. The cards to be provided to the subsequent hand 1680 may be predetermined when this particular trigger occurs. For example, a predetermined card group of 3 Aces may be provided to the subsequent hand 1680 when an Ace is dealt to card location 1676 of the current hand 1670, as depicted by cards 1671B, 1672B, and 1673B of subsequent hand 1680. The subsequent hand 1680 will therefore begin with 3 Aces, with the player's hopes of improving to a Four-of-a-Kind or Full House, when the subsequent hand 1680 is completed with the remaining cards 1681, 1682.

In another embodiment, cards to be provided to the subsequent hand 1680 in response to the trigger (Ace at card position 1676 in this example) may be randomly selected from a plurality of available enriched card sets, such as depicted at table 1677. In such an example, when the player is dealt an Ace to card position 1676, one of the available enriched card sets shown in table 1677 may be randomly selected. Such available enriched card sets may be randomly selected equally randomly, or with various weights assigned thereto. In the illustrated embodiment of FIG. 16G, assume that "3 Aces" was randomly selected among the plurality of options in table 1677, thereby enabling the subsequent hand 1680 to begin with Three-of-a-Kind, with the player's hopes of improving to a Four-of-a-Kind or Full House, when the subsequent hand 1680 is completed with the remaining cards 1681, 1682.

The examples of FIGS. 16A-16G depict representative examples of how subsequent hands may be equipped with enriched cards, as a result of being awarded the future benefit in an earlier hand, and do not represent an exhaustive list. Rather, these examples provide representative manners in which subsequent hand enrichment features may be accomplished.

In addition to the card or groups of cards being provided to a subsequent hand, additional benefits may also be provided. For example, the indicator used to identify the subsequent hand award, and/or any other manner of providing information, may additionally specify payout modifiers, enhanced card features, bonus games, free games, and the like. For example, an indicator (e.g. indicators 1220, 1314, 1505 of FIGS. 12, 13, 15 respectively) may also identify a multiplier, or delayed multiplier, for use on the subsequent hand that receives the enriched cards. As another example, the enriched cards may include, or one or more be changed to, split cards, where multiple cards may represent a position, which is also described U.S. Pat. No. 8,323,085, entitled "Method And Apparatus For Increasing Potential Payout Opportunities In Card Games," issued Dec. 4, 2012, the content of which is hereby incorporated by reference in its entirety. Enriched cards may also include cards with credit values associated therewith, or any other further advantage over the card had it not been enriched.

Betting structure could be done in any desired manner. For example, the player may place a wager for a base poker game, and some additional amount to be eligible for the card enrichment features described herein. The additional amount may be a single amount to participate in all hands, or on a hand-by-hand basis, such as a particular additional wager for each hand in a multi-play poker game.

Examples include a five-credit wager for each hand in the primary poker game, plus zero additional amounts to participate in the card enrichment features (e.g., 5+0); a five-credit wager for the primary poker game, plus one additional credit for each hand played to participate in the card enrichment features (e.g., 5+1); 5+2; 5+3; 5+4; 5+5; 5+45, and so forth. For example, in a triple-play poker game (i.e. three hands concurrently played) where 5 credits are wagered for each hand played and 5 additional credits for each hand to be eligible for a card enrichment trigger for subsequent hands, a total of 30 credits would be wagered (e.g., 5+5+5 for the wager for 3 primary poker hands, plus 5+5+5 to make three hands eligible for receipt of sub-symbols, highlights, or other indications for card enrichment on subsequent hands). Analogously, in a single-play poker game where 5 credits are wagered for the hand played and 5 additional credits are required to participate in the subsequent hand enrichment feature, a total of 10 credits would be wagered to play the game and be eligible for the subsequent hand enrichment feature.

It should also be noted that obtaining a subsequent hand card enrichment would involve the player wagering to participate in that subsequent game. Other embodiments may provide the player with the subsequent game without further wager, as part of the benefit of being awarded the subsequent hand benefit.

The subsequent enrichment may be used in connection with other gaming activities, such as, for example, keno and bingo. In these situations, numbers marked in a current game can cause beneficial numbers to be available in the subsequent game.

Figure 17A:
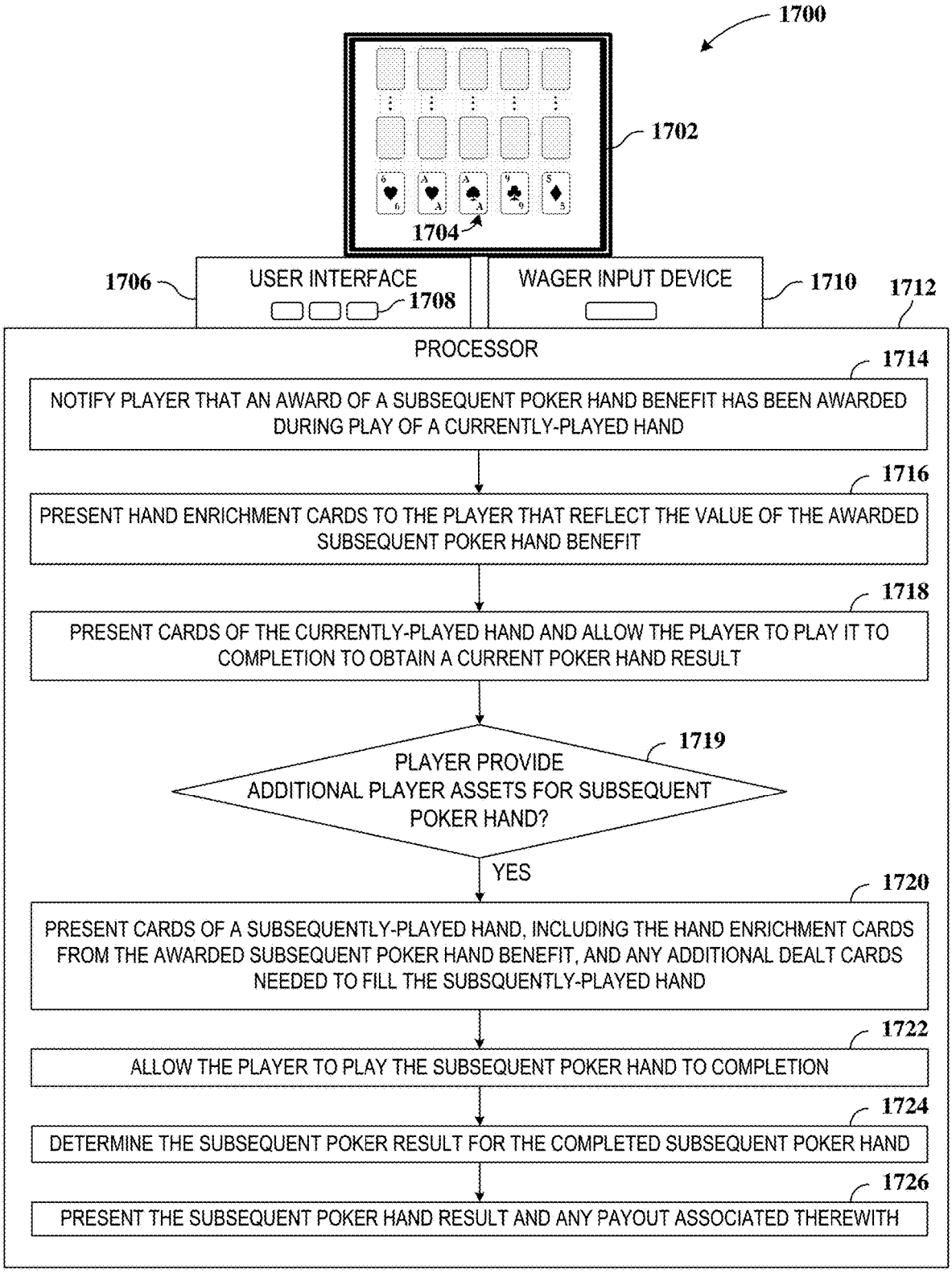
FIGS. 17A and 17B depict representative gaming apparatuses for enriching a subsequent poker game/hand based on cards or card groups identified in a poker game/hand played prior to the subsequent poker game/hand.
Figure 17B:
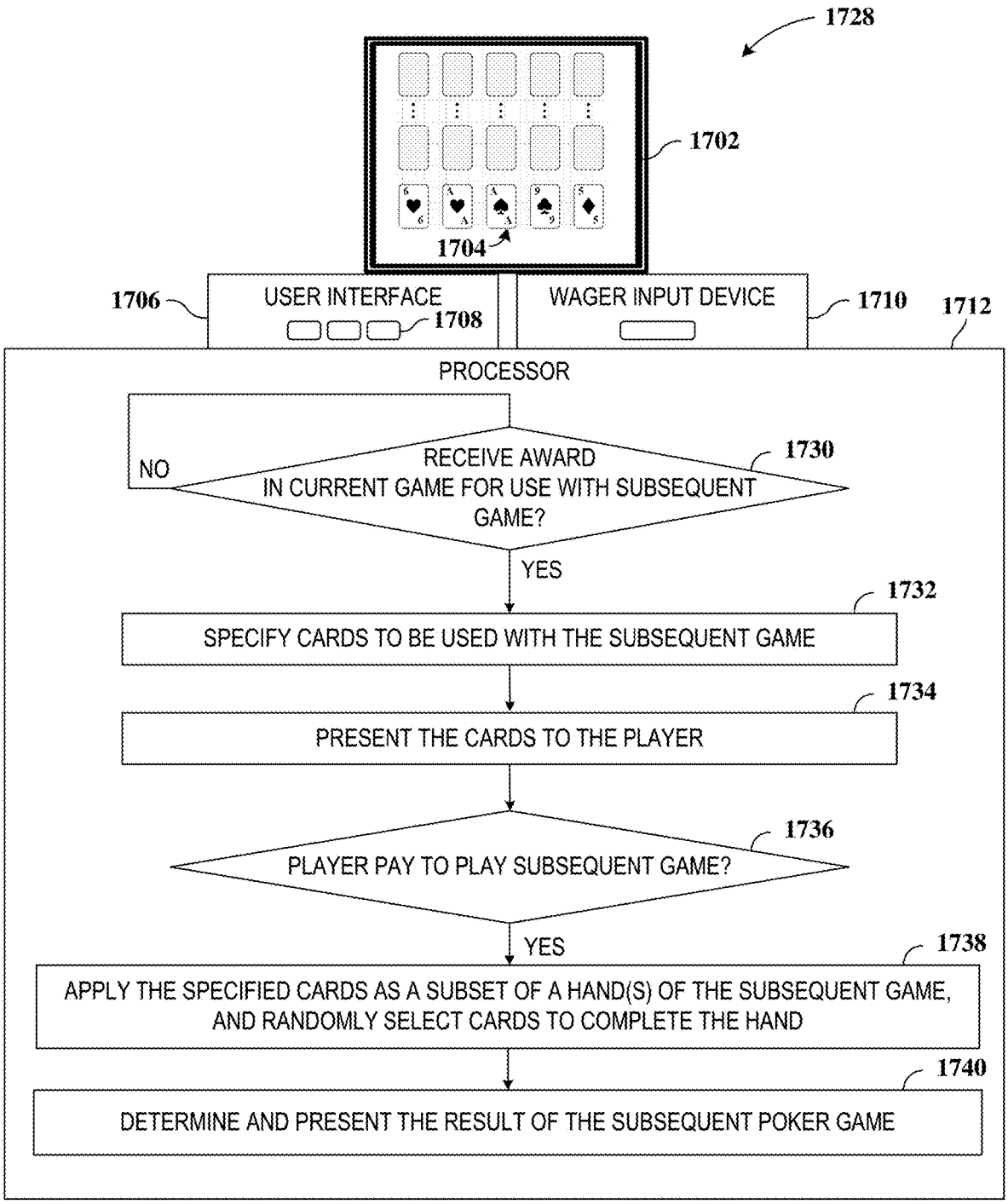

FIGS. 17A and 17B depict representative gaming apparatuses for enriching a subsequent poker game/hand based on cards or card groups identified in a poker game/hand played prior to the subsequent poker game/hand. FIGS. 17A and 17B both include multiple process steps carried out via a processor, which may be any single or multiple devices, centralized or distributed, or otherwise working collectively as a processing apparatus. The various processor-facilitated process steps may be implemented using software or code executable by the processor to carry out the various functions. These processes are depicted in an order for purposes of illustration, but the order of these processes may be changed in other embodiments without deviating from the scope or spirit of this concept. Accordingly, the order of the processes shown is for illustrative purposes only and is not meant to be restrictive. Additional game processes may also be included between various processes even though they are not shown in these process diagrams for clarity purposes. Each of the processes may be performed by components in a single game device, such as by a game processor(s), or may be performed in part or whole by a remote server or processor(s) connected to the gaming device via a network. Each process may be encoded in instructions that are stored in one or more memories, a computer-readable medium(s), or another type of storage device(s). The exemplary methods depict representative embodiments of how game operations may be implemented. As discussed herein, many variations exist which may require additional, fewer, or different processes to complete.

Referring first to FIG. 17A, a video poker apparatus 1700 is provided for facilitating player participation in electronic poker games. The video poker apparatus 1700 includes a display 1702 that can present the one or more hands 1704 involved in the poker game. A user interface 1706 is provided that includes at least one user input 1708 to, among other things, to interact with the player to facilitate player participation in the poker game. A wager input device 1710 is structured to identify and validate player assets and permit the player to participate in the electronic poker games in which the player assets are provided. The video poker apparatus 1700 also includes a processor 1712 coupled to the display 1702, user interface 1706, and the wager input device 1710. In one embodiment, the processor 1712 is configured to notify 1714 the player, such as via the display 1702, that an award of a subsequent poker hand benefit has been awarded on a currently-played one of the successive poker games in which the player is permitted to participate. The processor 1712 presents 1716 hand enrichment cards reflecting the subsequent poker hand benefit. The processor further presents 1718 a current hand of cards in association with the currently-played poker game and enables the current hand of cards to be played to a current poker hand result. The processor 1712 then determines 1719 whether the player has provided additional player assets to participate in a subsequent poker hand(s), and if so, presents 1720 a subsequent poker hand of cards, that includes the hand enrichment cards presented 1716 in the earlier hand, and includes one or more additional dealt cards to complete the subsequent poker hand of cards. The processor is configured to allow 1722 the subsequent poker hand to be played to completion, to determine 1724 a subsequent poker hand result for the completed subsequent poker hand that includes the hand enrichment cards and the additional dealt cards, and to present 1726 the subsequent poker hand result and any payout associated therewith.

FIG. 17B depicts a video poker apparatus 1728 for facilitating player participation in electronic poker games. The video poker apparatus of FIG. 17B includes the display 1702, user interface 1706 and user input 1708, wager input device 1710, and processor 1712 as in FIG. 17A, and therefore like reference numbers are used. The processor of the video poker apparatus 1728 of FIG. 17B determines 1730 whether the player has, in connection with playing a current poker game, randomly received an award for use with a subsequent poker game. In response to determining 1730 that the player has randomly received the award, the processor 1712 specifies 1732 a plurality of cards to be used with the subsequent poker game, and presents 1734 the specified cards to the player via the display that presents the current one of the electronic poker games. When the processor 1712 determines 1736 that the player has allocated player assets to initiate and participate in the subsequent poker game, the processor 1712 applies 1738 the specified plurality of cards as a subset of a hand associated with the subsequent poker game, and randomly selects cards for remaining positions of the hand. The processor 1712 is further configured to determine 1740 a poker result for the hand, and present that poker result to the player via the display.

The foregoing description of the representative embodiments has been presented for the purposes of illustration and description. It is not intended to be exhaustive or to limit the invention to the precise form disclosed. Many modifications and variations are possible in light of the above teaching. For example, the present invention is equally applicable in electronic or mechanical gaming machines, and is also applicable to live table versions of gaming activities that are capable of being played in a table version (e.g., machines involving poker or card games that could be played via table games).

Some embodiments have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention covers alternatives, modifications, and equivalents that come within the scope and spirit of the principles set out herein and/or in the appended claims.

What is claimed is:

1. A video poker apparatus comprising:

a display;

a user interface configured to generate signals in response to inputs from a player to facilitate player participation in the poker game;

a wager input device structured to receive physical items associated with currency values;

a processor coupled to the display, user interface, and wager input device, and configured to:

receive a signal indicating receipt of a physical item associated with a currency value;

increase the credit amount stored in the memory based on the currency value associated with the received physical item;

receive a first game initiation signal from the player interface including a first wager amount to initiate a first poker game, the first wager amount deducted from the credit amount stored in the memory;

determine whether a randomly received award in the first poker game is to be used with a subsequent poker game, where if the processor determines that the randomly received award in the first poker game is to be used with the subsequent poker game, specify a plurality of cards to be used with the subsequent poker game and present the specified plurality of cards via the display;

evaluate a first poker hand in the first poker game for first poker awards;

increase the credit amount stored in the memory by any first poker awards in the first poker game;

receive a second game initiation signal from the player interface including a second wager amount to initiate a second poker game after any first poker awards in the first poker game have increased the credit amount stored in the memory, the second wager amount deducted from the credit amount stored in the memory;

apply the specified plurality of cards as a subset of a second dealt poker hand associated with the second poker game, and randomly select cards for remaining positions of the second dealt poker hand;

determine a poker result for the second poker game; and increase the credit amount stored in the memory by any second poker awards associated with the determined poker result of the second poker game.

2. The video poker apparatus of claim 1, wherein the processor is further configured to present, via the display, a visual indication indicating that the randomly received award in the first poker game is to be used with the subsequent poker game.

3. The video poker apparatus of claim 2, wherein the processor is further configured to specify the plurality of cards to be used with the subsequent poker game by presenting, via the display, visual representations of specific cards of a virtual deck that will be used with the subsequent poker game.

4. The video poker apparatus of claim 2, wherein the processor is further configured to specify the plurality of cards to be used with the subsequent poker game by presenting, via the display, a textual representation of a card group forming a subset of a predetermined winning poker result having a payout associated therewith.

5. The video poker apparatus of claim 2, wherein the processor is further configured to specify the plurality of cards to be used with the subsequent poker game by presenting, via the display, indicia having corresponding specific cards or a card group in a correlation table.

6. The video poker apparatus of claim 1, wherein the processor is further configured to determine whether the player has randomly received an award for use with a subsequent poker game by determining whether randomly-presented cards used in the first poker game match predetermined card characteristics set to trigger the random receipt of the award for use with the subsequent poker game.

7. The video poker apparatus of claim 6, wherein the processor is further configured to specify the plurality of cards to be used with the subsequent poker game to be the same randomly-presented cards used in the first poker game that matched the predetermined card characteristics.

8. The video poker apparatus of claim 1, wherein the processor is further configured to determine whether the player has randomly received an award for use with a subsequent poker game by determining whether one or more randomly-presented cards provided at particular card positions of the first poker hand in the first poker game matches predetermined card characteristics.

9. The video poker apparatus of claim 1, wherein the processor is configured to select the plurality of cards to be used with the subsequent poker game from a plurality of available groups of cards.

10. The video poker apparatus of claim 1, wherein the processor is configured to specify the plurality of cards to be used with the subsequent poker game as specific cards from one or more electronic decks of cards.

11. The video poker apparatus of claim 1, wherein the processor is configured to specify the plurality of cards to be used with the subsequent poker game as card groups sharing at least one common characteristic from one or more electronic decks of cards.

12. The video poker apparatus of claim 1, wherein the processor is further configured to determine whether the poker result corresponds to a predetermined winning poker result, and if so, to provide a payout based on the poker result.

13. The video poker apparatus of claim 1, wherein the poker result is based on the specified plurality of cards and the randomly select cards.

14. The video poker apparatus of claim 1, wherein the processor is further configured to facilitate player participation in the hand associated with the subsequent poker game prior to determining the poker result for the hand.

15. The video poker apparatus of claim 14, wherein the processor is further configured to randomly select one or more additional cards, and to facilitate player selection of a five-card hand by retaining five of the cards from a group comprising the specified plurality of cards, the randomly selected cards, and the randomly selected one or more additional cards.

16. The video poker apparatus of claim 14, wherein the processor is further configured to:

facilitate player retaining of any one or more of the cards of a group comprising the specified plurality of cards and the randomly selected cards;

facilitate player discarding of any of the cards of the group that were not retained;

provide replacement cards in place of the discarded cards; and determine the poker result based on the retained cards and the replacement cards.

* * * * *